US008541153B2

(12) United States Patent
Matsumura et al.

(10) Patent No.: US 8,541,153 B2
(45) Date of Patent: Sep. 24, 2013

(54) TONER FOR DEVELOPING ELECTROSTATIC IMAGE, DEVELOPER FOR ELECTROSTATIC IMAGE, TONER CARTRIDGE, PROCESS CARTRIDGE, IMAGE FORMING METHOD, AND IMAGE FORMING APPARATUS

(75) Inventors: Yasuo Matsumura, Kanagawa (JP); Hirotaka Matsuoka, Kanagawa (JP); Hideo Maehata, Kanagawa (JP); Yuki Sasaki, Kanagawa (JP); Fumiaki Mera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 351 days.

(21) Appl. No.: 12/871,311

(22) Filed: Aug. 30, 2010

(65) Prior Publication Data

US 2011/0171572 A1 Jul. 14, 2011

(30) Foreign Application Priority Data

Jan. 12, 2010 (JP) ..... 2010-003871

(51) Int. Cl.
*G03G 9/08* (2006.01)

(52) U.S. Cl.
USPC ..... 430/108.4; 430/108.1; 430/137.14; 430/105; 430/124.11; 399/262; 399/111; 399/252

(58) Field of Classification Search
USPC ..... 430/108.4, 108.1, 137.14, 105, 124.11; 399/262, 111, 252
See application file for complete search history.

(56) References Cited

U.S. PATENT DOCUMENTS

| | | | | |
|---|---|---|---|---|
| 5,543,177 | A * | 8/1996 | Morrison et al. | 430/108.1 |
| 6,355,390 | B1 * | 3/2002 | Yamanami et al. | 430/60 |
| 2005/0031870 | A1 * | 2/2005 | Liu et al. | 428/402 |
| 2009/0004583 | A1 * | 1/2009 | Nukada et al. | 430/58.5 |
| 2009/0068366 | A1 * | 3/2009 | Aklian et al. | 427/385.5 |
| 2010/0047706 | A1 * | 2/2010 | Matsumura et al. | 430/108.4 |

FOREIGN PATENT DOCUMENTS

| | | |
|---|---|---|
| JP | 2008-209489 | 9/2008 |
| JP | 2008-233736 | 10/2008 |

OTHER PUBLICATIONS

Juan A. Gonzalez-Leon et al. "Core-Shell Polymer Nanoparticles for Baroplastic Processing." Macromolecules 2005, vol. 38, pp. 8036-8044 (2005).

Johng-Wook Ha et al. "Preparation and Characterization of Core-Shell Particles Containing Perfluoroalkyl Acrylate in the Shell." Macromolecules 2002, vol. 35, pp. 6811-6818 (2002).

Du Yeol Ryu et al. "Complex Phase Behavior of a Weakly Interacting Binary Polymer Blend." Macromolecules 2004, vol. 37, pp. 5851-5855 (2004).

J.S. Guo, M.S. El-Asser, and J.W. Vanderhoff "Microemulsion Polymerization of Styrene." Journal of Polymer Science: Part A: Polymer Chemistry, vol. 27, pp. 691-710 (1989).

* cited by examiner

*Primary Examiner* — Mark F Huff
*Assistant Examiner* — Rachel Zhang
(74) *Attorney, Agent, or Firm* — Oliff & Berridge, PLC

(57) ABSTRACT

A toner for developing an electrostatic image contains at least one of an oxidation polymerizable monomer and a polymer having an ethylenically unsaturated group, and an oxidation polymerization catalyst in a form of a composite with inorganic particles, wherein a temperature T(10 Mpa) and a temperature T(1 Mpa) satisfies the following expression (1):

$$20^\circ\ \text{C.} \leq T(1\ \text{MPa}) - T(10\ \text{MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

17 Claims, No Drawings

TONER FOR DEVELOPING ELECTROSTATIC IMAGE, DEVELOPER FOR ELECTROSTATIC IMAGE, TONER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2010-003871 filed Jan. 12, 2010.

BACKGROUND

1. Technical Field

The present invention relates to a toner for developing an electrostatic image, a developer for an electrostatic image, a toner cartridge, a process cartridge, an image forming method, and an image forming apparatus.

2. Related Art

A toner for developing an electrostatic image using an addition polymerization resin or a polycondensation resin as a binder resin has been ordinarily fixed mainly by heating rather than pressurizing owing to the use of a random monomer unit chain.

On the other hand, pressure fixing of a toner for developing an electrostatic image at ordinary temperature has been variously studied by using wax, a solid core capsule structure, a liquid core capsule structure or the like.

However, an image formed with the toner fixed under pressure at ordinary temperature is generally poor in durability as compared to a printed image, and is liable to suffer adhesion between images when the images are accumulated under pressure as in a book binding process and exposed to summer sunlight, and to suffer blur of an image when the image is printed on heavy paper or a film for packaging, as compared to the ordinary printing process.

The pressure fixing of a toner enhances the variation of transfer media, to which toner images are fixed, and therefore, there is an increasing demand on improvement of durability of the toner images.

SUMMARY

According to an aspect of the invention, there is provided a toner for developing an electrostatic image, including at least one of an oxidation polymerizable monomer and a polymer having an ethylenically unsaturated group, and an oxidation polymerization catalyst in a form of a composite with inorganic particles, wherein a temperature T(10 Mpa) and a temperature T(1 Mpa) satisfies the following expression (1):

$$20^\circ\ \text{C.} \leq T(1\ \text{MPa}) - T(10\ \text{MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

DETAILED DESCRIPTION

Toner for Developing Electrostatic Image

A toner for developing an electrostatic image (which may be hereinafter referred simply to a toner) according to an exemplary embodiment of the invention contains an oxidation polymerizable monomer and/or a polymer having an ethylenically unsaturated group, and an oxidation polymerization catalyst in a form of a composite with inorganic particles. The toner has a temperature T(10 MPa) where the toner has a viscosity of $10^4$ Pa·s at a pressure of 10 MPa applied with a flow tester and a temperature T(1 MPa) where the toner has a viscosity of $10^4$ Pa·s at a pressure of 1 MPa applied with a flow tester that satisfy the following expression (1):

$$\text{approximately } 20^\circ\ \text{C.} \leq T(1\ \text{MPa}) - T(10\ \text{MPa}) \quad (1)$$

The toner for developing an electrostatic image according to the exemplary embodiment may be favorably used as a toner for pressure fixing.

In the exemplary embodiment, the expression showing a range "from A to B" means "A or more and B or less", i.e., a range including the end points, A and B, unless otherwise indicated.

In the exemplary embodiment, the toner is collapsed with pressure for fixing on a printing medium, such as a transfer belt, a film or paper, and the oxidation polymerizable monomer and/or the polymer having an unsaturated bond present in one region of the toner and the oxidation polymerization catalyst in the form of a composite with inorganic particles present in another region of the toner are dissolved and mixed with each other and are in contact with each other, whereby polymerization or crosslinking reaction occurs to cure the entire toner image.

The oxidation polymerizable monomer and/or the polymer having an unsaturated bond, and the oxidation polymerization catalyst in the form of a composite with inorganic particles contained in the toner may not be in contact with each other in the state of toner particles before transferring and fixing, but may be in contact with each other through fixing the toner, thereby causing oxidation polymerization gradually to enhance the fixing property of the toner.

Accordingly, the oxidation polymerizable monomer and/or the polymer having an unsaturated bond, and the oxidation polymerization catalyst in the form of a composite with inorganic particles each may be present in separate regions respectively.

Examples of the toner having such a structure include a toner having a core-shell structure, in which the oxidation polymerizable monomer and/or the polymer having an ethylenically unsaturated group is contained in the core, and the oxidation polymerization catalyst in the form of a composite with inorganic particles is contained in the shell. Examples thereof also include a toner having a core-shell structure, in which the oxidation polymerizable monomer and/or the polymer having an ethylenically unsaturated group is contained in the shell, and the oxidation polymerization catalyst in the form of a composite with inorganic particles is contained in the core. The toner in the exemplary embodiment is not limited to the aforementioned structures, and may have such a structure that the oxidation polymerizable monomer and/or the polymer having an ethylenically unsaturated group is contained in the toner mother particles, and the oxidation polymerization catalyst in the form of a composite with inorganic particles is added as an external additive of the toner, or such a structure that the oxidation polymerization catalyst in the form of a composite with inorganic particles may be added to the outer shell and/or the surface of the toner.

It seems that the structure, in which the oxidation polymerizable monomer and/or the polymer having an ethylenically unsaturated group is contained in the toner mother particles, and the oxidation polymerization catalyst in the form of a composite with inorganic particles is disposed as an external additive, can be achieved easily. However, it is not necessarily favorable to form a catalyst compound into fine particles having a diameter of from several nanometers to several hundreds nanometers, which is the case of an ordinary external additive, and thereby the homogeneity in flow mixing upon fixing may be impaired. Accordingly, there are cases where advantages cannot be obtained.

As a result of earnest investigations made by the inventors for addressing the problems, it has been found that advantages can be obtained in such a manner that an oxidation polymerization catalyst is supported on the surface of inorganic particles, such as silica and titania, ordinarily used as an external additive, thereby forming a composite of the oxidation polymerization catalyst and the inorganic particles, and the composite is disposed homogeneously on the surface of the toner.

The oxidation polymerization catalyst in the form of a composite with inorganic particles in the exemplary embodiment includes an oxidation polymerization catalyst adsorbed physically on the surface of inorganic particles, an oxidation polymerization catalyst coated on the surface thereof with inorganic particles, particles containing both kinds of the particles, and the like.

In the following description, the toner for developing an electrostatic image used in the exemplary embodiment will be described, and then a developer for an electrostatic image, a toner cartridge, a process cartridge, an image forming apparatus and an image forming method, according to exemplary embodiments will be described.

Oxidation Polymerizable Monomer and/or Polymer Having Ethylenically Unsaturated Group The toner for developing an electrostatic image according to the exemplary embodiment contains an oxidation polymerizable monomer and/or a polymer having an ethylenically unsaturated group, and preferably contains an oxidation polymerizable monomer.

Oxidation Polymerizable Monomer

Examples of the oxidation polymerizable monomer used in the exemplary embodiment include a compound having an ethylenically unsaturated group having a molecular weight of less than approximately 1,000.

Compound Having Ethylenically Unsaturated Group Having Molecular Weight of Less than Approximately 1,000 Drying Oil Examples of the compound having an ethylenically unsaturated group having a molecular weight of less than approximately 1,000 used in the exemplary embodiment include a drying oil. The drying oil used in the exemplary embodiment is not particularly limited, and any known drying oil may be used.

The drying oil is a triglyceride of a fatty acid containing a fatty acid having an unsaturated bond, such as linolenic acid, linoleic acid and oleic acid.

Specific examples of the drying oil include linseed oil, tung oil, poppy seed oil, shiso oil, walnut oil, perilla oil, safflower oil and sunflower seed oil, and among these, linseed oil is preferred.

Others

Other examples of the compound having an ethylenically unsaturated group having a molecular weight of less than approximately 1,000 than the drying oil used in the exemplary embodiment include a known ethylenically unsaturated monomer.

Examples of the ethylenically unsaturated monomer include a compound having at least one ethylenically unsaturated group.

Examples of the radical-polymerizable ethylenically unsaturated compound used in the exemplary embodiment include a styrene compound, a (meth)acrylate ester compound (the expression "(meth)acrylate ester" or the like means "acrylate ester and/or methacrylate ester" or the like, hereinafter the same), an ethylenically unsaturated nitrile compound, an ethylenically unsaturated carboxylic acid compound, a vinyl ether compound, a vinyl ketone compound and an olefin compound.

Specific examples thereof include a styrene compound, such as styrene, p-chlorostyrene and α-methylstyrene; a (meth)acrylate ester compound, such as methyl acrylate, ethyl acrylate, propyl acrylate, butyl acrylate, hexyl acrylate, lauryl acrylate, 2-ethylhexyl acrylate, β-carboxyethyl acrylate, methyl methacrylate, ethyl methacrylate, propyl methacrylate, butyl methacrylate, hexyl methacrylate, lauryl methacrylate, 2-ethylhexyl methacrylate and cyclohexyl methacrylate; an ethylenically unsaturated nitrile compound, such as acrylonitrile and methacrylonitrile; an ethylenically unsaturated carboxylic acid compound, such as acrylic acid, methacrylic acid and crotonic acid; a vinyl ether compound, such as vinyl methyl ether and vinyl isobutyl ether; a vinyl ketone compound, such as vinyl methyl ketone, vinyl ethyl ketone and vinyl isopropenyl ketone; and an olefin compound, such as isoprene, butene and butadiene.

The oxidation polymerizable monomer may be contained solely in the toner or may be contained as a combination of two or more kinds thereof in the toner.

Polymer having Ethylenically Unsaturated Group

The polymer having an ethylenically unsaturated group used in the exemplary embodiment may be a polymer having at least one ethylenically unsaturated group, and may have a molecular weight (weight average molecular weight) of approximately 1,000 or more.

The position of the ethylenically unsaturated group in the polymer having the ethylenically unsaturated group may be the inside of the main chain or the end of the main chain, and is preferably the inside the main chain.

Examples of the polymer having the ethylenically unsaturated group include a polyester resin, a polyamide resin, an acrylic resin, a polystyrene resin and a polyolefin resin, each of which have at least one ethylenically unsaturated group.

Among these, a polyester resin having at least one ethylenically unsaturated group is preferred.

Examples of the polyester resin and the polyamide resin, each of which have an ethylenically unsaturated group include those produced with an unsaturated polycarboxylic acid, such as fumaric acid, maleic acid and dodecenylsuccinic acid, as a monomer.

Examples of the acrylic resin, the polystyrene resin and the polyolefin resin, each of which have at least one ethylenically unsaturated group include an acrylic resin, a polystyrene resin and a polyolefin resin, each of which are once produced and then introduced separately with an ethylenically unsaturated group.

The polymer having an ethylenically unsaturated group may be contained solely in the toner or may be contained as a combination of two or more kinds thereof in the toner.

The toner for developing an electrostatic image according to the exemplary embodiment may contain both the oxidation polymerizable monomer and the polymer having an ethylenically unsaturated group or may contain either one of them, and preferably contains both of them.

The total content of the oxidation polymerizable monomer and the polymer having an ethylenically unsaturated group in the toner for developing an electrostatic image according to the exemplary embodiment may be from approximately 0.1 to approximately 30.0% by weight, preferably from approximately 0.5 to approximately 20% by weight, and more preferably from approximately 1.0 to approximately 10% by weight, based on the total weight of the toner.

Oxidation Polymerization Catalyst

Examples of the oxidation polymerization catalyst used in the exemplary embodiment include a metal oxide, a metallic soap, an amine compound, a phosphorus-containing compound and a metal chelate compound.

Preferred examples of the metal oxide include silver oxide, copper oxide, titanium oxide and aluminum oxide, more preferred examples thereof include silver oxide and copper oxide, and further preferred examples thereof include silver oxide. The valency of the metallic atom in the metal oxide is not particularly limited. The silver oxide may be either $Ag_2O$ or AgO (a mixed oxide of Ag(I) and Ag(III)), and the copper oxide may be either $Cu_2O$, CuO or $Cu_2O_3$.

Preferred examples of the metallic soap include a metallic soap of a transition metal, more preferred examples thereof include a transition metal salt of a carboxylic acid having from 8 to 30 carbon atoms, further preferred examples thereof include cobalt naphthenate, manganese naphthenate and vanadyl octylate, and particularly preferred examples thereof include cobalt naphthenate.

Examples of the amine compound include dimethylaniline, phenylmorpholine, diethylenetriamine, triethylenetetramine, tetraethylenepentamine, diethylaminopropylamine, m-phenylenediamine, diaminodiphenylmethane, diaminodiphenylsulfone, m-xylenediamine, m-aminobenzylamine, benzidine, 4-chloro-o-phenylenediamine, bis(3,4-diaminophenyl) sulfone and 2,6-diaminopyridine.

Examples of the phosphorus-containing compound include phenylphosfinic acid.

Examples of the metal chelate compound include vanadyl acetylacetonate and aluminum acetylacetonate.

The oxidation polymerization catalyst may be used solely or may be used as a combination of two or more kinds thereof.

In the use of the oxidation polymerization catalyst, an oxidation enzyme may be used from the standpoint of addressing the safety issue of chemical substances in recent years and enhancing the environmental compatibility.

Examples of the oxidation enzyme used in the exemplary embodiment include a dehydrogenase, such as lactate dehydrogenase and alcohol dehydrogenase, an oxidase, such as glucose oxidase, hexose oxidase, cholesterol oxidase, urate oxidase, ascorbate oxidase and xanthine oxidase, an oxygenase, such as catechol 1,2-dioxygenase, tryptophan 2,3-dioxygenase, lipoxygenase (which is also referred to as lipoxidase), ascorbate 2,3-dioxygenase, indole 2,3-dioxygenase, cysteine dioxygenase, β-carotene 15,15'-dioxygenase, arginine 2-monooxygenase, lysine 2-monooxygenase and lactate 2-monooxygenase, and a hydroperoxidase, such as catalase and peroxidase.

A transition metal complex used as the oxidation polymerization catalyst is not particularly limited as far as it is a compound having a capability of oxidatively polymerizing a vegetable oil having an unsaturated group or a modified product of the vegetable oil, and examples thereof include various metals or complexes thereof, for example, salts of a metal, such as cobalt, manganese, lead, calcium, cerium, zirconium, zinc, iron and copper, with octylic acid, naphthenic acid, neodecanoic acid, stearic acid, resin acid, tall oil fatty acid, tung oil fatty acid, linseed oil fatty acid, soybean oil fatty acid or the like. In the exemplary embodiment, the metallic complex may be used solely or may be used as a combination of two or more kinds thereof.

Among the aforementioned metals, iron may be favorably used from the standpoint of addressing the safety issue of chemical substances in recent years and enhancing the environmental compatibility.

In addition to the metallic complex containing iron, an iron compound, such as an iron oxide compound (particularly, $Fe_2O_3$ and $Fe_3O_4$), iron chloride ($FeCl_3$) and imidazolyl-substituted iron(III) porphyrin diner, may be favorably used as the oxidation polymerization catalyst from the same standpoint as above.

For forming the oxidation polymerization catalyst into fine particles as an external additive, the oxidation polymerization catalyst may be supported on the surface of inorganic fine particles, thereby forming a composite of the oxidation polymerization catalyst and the inorganic fine particles. Examples of the inorganic fine particles include silica, titania, alumina and zirconia, and preferred examples thereof include silica and titania.

The inorganic fine particles may have a particle diameter of from several nanometer to several hundreds nanometers, and preferably approximately 100 nm or less.

Upon forming the composite with the inorganic fine particles, the oxidation polymerization catalyst is formed into ultra-fine particles with a diameter of several tens nanometers as an external additive.

The oxidation polymerization catalyst formed into a composite with the inorganic fine particles may be contained in the outer shell and/or the surface of the toner for developing an electrostatic image.

The composite of the oxidation polymerization catalyst and the inorganic fine particles may be formed, for example, in the following manner.

(1) The oxidation polymerization catalyst is dissolved in a solvent, such as an alcohol.

(2) The inorganic fine particles, such as silica and titania, having a particle diameter of from several nanometers to several hundreds nanometers are mixed with the solution obtained in (1).

(3) The solvent is removed from the mixture obtained in (2) under stirring with an evaporator or the like with depressurization with a vacuum pump.

(4) The product obtained in (3) is pulverized into fine particles with a Henshell mixer or the like to complete the formation of the composite.

The total content of the oxidation polymerization catalyst having been formed into a composite with inorganic particles in the toner for developing an electrostatic image according to the exemplary embodiment may be from approximately 0.001 to approximately 10.0% by weight, preferably from approximately 0.005 to approximately 5.0% by weight, and more preferably from approximately 0.01 to approximately 3.0% by weight, based on the total weight of the toner.

The oxidation polymerization catalyst having been formed into a composite with inorganic particles may have a volume average particle diameter of from approximately 0.001 to approximately 3 μm, and preferably from approximately 0.01 to approximately 2.0 μm.

Pressure Dependency

The toner for developing an electrostatic image according to the exemplary embodiment has a temperature T(10 MPa) where the toner has a viscosity of $10^4$ Pa·s at a pressure of 10 MPa applied with a flow tester and a temperature T(1 MPa) where the toner has a viscosity of $10^4$ Pa·s at a pressure of 1 MPa applied with a flow tester that satisfy the following expression (1):

$$\text{approximately } 20^\circ\text{ C.} \leq T(1\text{ MPa}) - T(10\text{ MPa}) \quad (1)$$

In the case where the value (T(1 MPa)−T(10 MPa)) is less than approximately 20° C., the fixing property may be insufficient.

In the case where the value (T(1 MPa)−T(10 MPa)) exceeds approximately 120° C., a fixing roller tends to be contaminated. Accordingly, the values T(1 MPa) and T(10 MPa) preferably satisfy the following expression (1'):

$$\text{approximately } 20^\circ\text{ C.} \leq T(1\text{ MPa}) - T(10\text{ MPa}) \leq \text{approximately } 120^\circ\text{ C.} \quad (1)$$

The value (T(1 MPa)−T(10 MPa)) may be from approximately 20 to approximately 120° C., preferably from approximately 30 to approximately 110° C., and more preferably from approximately 40 to approximately 100° C.

The measurement with a flow tester is performed under the following conditions.

A flow tester, CFT500C, available from Shimadzu Corporation, is used, and the softened state upon increasing temperature with constant rate is measured with a starting temperature of 40° C. to a maximum temperature of 170° C., a temperature increasing rate of 3° C. per minute, a preheating time of 300 seconds, a cylinder pressure variable from 10 to 100 kgf/cm$^2$ and a die having a length of 1.0 mm and a diameter of 1.0 mm.

It is difficult to fractionate only the resin component from the toner, and thus the toner itself is weighed to prepare a specimen. The plunger cross sectional area is 10 cm$^2$. The measurement is performed as follows. Upon increasing the temperature at a constant rate, the specimen is gradually heated and is started to flow. Upon further increase of the temperature, the specimen in a molten state largely flows to terminate descent of the plunger, thereby completing one measurement. The flow amounts at respective temperatures are measured from 40 to 150° C. with an interval of 3° C., thereby providing an apparent viscosity η' (Pa·s). The temperatures where the apparent viscosity η' (Pa·s) becomes $1\times10^4$ Pa·s at a pressure of 10 MPa applied with the flow tester and a pressure of 1 MPa applied with the flow tester are obtained, and the difference of the temperatures is calculated.

Binder Resin

For imparting the aforementioned pressure dependency to the toner, the toner for developing an electrostatic image according to the exemplary embodiment may contain a resin that exhibits a plasticization behavior to pressure (which may be hereinafter referred to as a pressure-fixing binder resin).

In the case where a high-Tg resin (i.e., a resin having a high glass transition temperature) and a low-Tg resin (i.e., a resin having a low glass transition temperature) form a microscopic phase separation state, the resin exhibits a plasticization behavior to pressure and shows flowability within ordinary temperature range under a certain pressure or more. The kind of the resin may be referred to as baroplastics. The plasticization flow behavior is accelerated at a higher atmospheric temperature, and the resin flowability that is necessary for fixing under a lower pressure is obtained.

The toner is imparted with flowability upon application of a certain pressure or more, and is made to behave as a solid matter at a pressure lower than the certain pressure, whereby high reliability is ensured in operations in an electrophotographic process other than pressure fixing (or heat-pressure fixing), i.e., developing, transferring, cleaning and the like.

A toner having a small particle diameter of 5 μm or less, which has been difficult to be realized, can be used owing to the high reliability imparted thereto, whereby reduction of consumption of the toner and high definition images are realized, and thus high image quality, reliability and economy owing to the reduction of consumption of the toner are achieved simultaneously.

In the exemplary embodiment, the pressure plasticization effect upon pressure-fixing of a microscopic phase separation resin containing domains different in Tg may be positively employed, and simultaneously an analogous pressure flow compound may be contained, whereby both the low temperature fixing property and the reliability upon conveying paper are expected to be achieved.

The toner for developing an electrostatic image according to the exemplary embodiment containing the pressure-fixing binder resin may be (1) or (2) shown below.

(1) A toner for developing an electrostatic image is obtained by aggregating resin particles having a core-shell structure (core-shell particles) from a resin particle dispersion liquid containing the resin particles.

The difference between the glass transition temperature (Tg) of the resin constituting the core and the glass transition temperature (Tg) of the resin constituting the shell may be approximately 20° C. or more, and preferably from approximately 20 to approximately 120° C. The resin constituting the shell may contain an acidic or basic polar group or an alcoholic hydroxyl group.

(2) A toner for developing an electrostatic image is obtained by aggregating resin particles of a block copolymer having a crystalline polyester block and a non-crystalline polyester block from a resin dispersion liquid.

The resin particles having a core-shell structure (core-shell particles) or the block copolymer may be formed into a toner by a known kneading and pulverizing method, and then the oxidation polymerization catalyst particles may be attached as an additive to the surface of the toner, i.e., a so-called external additive, thereby providing the similar effect. However, the toner may be produced by the chemical production method capable of forming the toner at a relatively low temperature and low pressure since it is difficult to maintain the microscopic phase separation structure of the resin during the kneading operation.

The pressure-fixing binder resin will be described in detail below.

Core-Shell Particles

The toner used in the exemplary embodiment may be a toner for developing an electrostatic image obtained by aggregating resin particles having a core-shell structure (which may be hereinafter referred simply to as core-shell particles), in which the resin constituting the cover and the resin constituting the shell are both non-crystalline resins, and the difference between the glass transition temperature (Tg) of the resin constituting the core and the glass transition temperature (Tg) of the resin constituting the shell may be approximately 20° C. or more, and the resin constituting the shell contains an acidic or basic polar group or an alcoholic hydroxyl group.

In the exemplary embodiment, the toner may be produced by a kneading and pulverizing method using the core-shell particles as a binder resin.

In the resin constituting the core and the resin constituting the shell, the core or shell having the higher Tg may be referred to as a high Tg phase, and the shell or core having the lower Tg may be referred to as a low Tg phase.

The glass transition temperature (Tg) of the high Tg phase may be from approximately 40 to approximately 80° C., and preferably from approximately 45 to approximately 70° C.

When the Tg of the high Tg phase is approximately 40° C. or more, the toner is excellent in storage stability, thereby preventing caking from occurring during transportation and in a device, such as a printer, preventing filming to a photoconductor from occurring upon continuous printing or the like, and preventing image defects from occurring. When the Tg of the high Tg phase is approximately 80° C. or less, the toner can be fixed at an appropriate fixing temperature, thereby preventing damages on a recording material, such as curing, from occurring, and also enabling fixing without heating.

The Tg of the low Tg phase may be lower than the Tg of the high Tg phase by approximately 20° C. or more, and preferably approximately 30° C. or more. When the difference in Tg between the high Tg phase and the low Tg phase is approximately 20° C. or more, a favorable pressure plasticization behavior is observed, thereby lowering the fixing temperature required on fixing, and providing good low temperature fixing property.

The glass transition temperature of the resin may be measured by a known method, for example, the method defined in ASTM D3418-82 (DSC method).

The term "crystallinity" as in the crystalline resin means that the resin has a clear endothermic peak, but not a stepwise endothermic change, in the differential scanning calorimetry (DSC), and specifically means that the half value width of the endothermic peak measured at a temperature increasing rate of 10° C. per minute is 15° C. or less.

On the other hand, a resin having a half value width of the endothermic peak exceeding 15° C. or a resin having no clear endothermic peak is designated as a non-crystalline (amorphous) resin. The glass transition temperature of a non-crystalline resin by DSC may be measured with a differential scanning calorimeter equipped with an automatic tangent processor, DSC-50, available from Shimadzu Corporation, or the like, according to ASTM D3418. The measurement conditions are as follows.

Specimen: 3 to 15 mg, preferably 5 to 10 mg

Measurement method: A specimen is placed in an aluminum pan, and a blank aluminum pan is used as the control.

Temperature curve: temperature rising I (20 to 180° C., rate: 10° C. per minute)

The glass transition temperature is obtained from an endothermic curve measured upon increasing the temperature in the temperature curve.

The glass transition temperature is a temperature, at which the derivative value of the endothermic curve becomes maximum.

A core-shell particle constituted by resins different in Tg in the core and shell respectively can be obtained, for example, by emulsion polymerization using a method of feeding monomers stepwise to the polymerization system, which is referred to as two-stage feeding.

However, there is such a possibility that when core-shell particles are subjected to mixing process at high temperature and high pressure as in a kneading method for producing a toner, the phase separation structure precisely formed is broken to fail to provide the target characteristics. Accordingly, a production process of forming particles in an aqueous medium, such as water, is suitable for the production process of the toner.

The toner may be produced with the resin thus produced as a binder resin by a dissolution and suspension method, an emulsion aggregation method or the like according to a known production process.

Examples of the production process of core-shell particles containing resins different in Tg in the core and shell respectively include: Core-Shell Polymer Nanoparticles for Baroplastic Processing, Macromolecules, vol. 38, pp. 8036-8044 (2005); Preparation and Characterization of Core-Shell Particles Containing Perfluoroalkyl Acrylate in the Shell, Macromolecules, vol. 35, pp. 6811-6818 (2002); and Complex Phase Behavior of a Weakly Interacting Binary Polymer Blend, Macromolecules, vol. 37, pp. 5851-5855 (2004).

The resins used in the core-shell particles in the exemplary embodiment are not particularly limited as far as the resins are non-crystalline resins and the difference in Tg between the resin used in the core and the resin used in the shell is approximately 20° C. or more, and each may be a non-crystalline addition polymerization resin, and preferably a non-crystalline homopolymer or copolymer of an ethylenically unsaturated monomer.

Examples of the monomer constituting the homopolymer or copolymer include a styrene compound, such as styrene, p-chlorostyrene and α-methylstyrene; a (meth)acrylate ester compound, such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate and 2-ethylhexyl methacrylate; an ethylenically unsaturated nitrile compound, such as acrylonitrile and methacrylonitrile; an ethylenically unsaturated carboxylic acid compound, such as acrylic acid, methacrylic acid and crotonic acid; a vinyl ether compound, such as vinyl methyl ether and vinyl isobutyl ether; a vinyl ketone compound, such as vinyl methyl ketone, vinyl ethyl ketone and vinyl isopropenyl ketone; an olefin compound, such as isoprene, butene and butadiene; and β-carboxyethyl acrylate. A homopolymer containing the monomer, a copolymer obtained by copolymerizing two or more kinds of the monomers, and a mixture thereof may be used.

Specific examples of the combination where the difference in Tg is approximately 20° C. or more and a microscopic phase separation structure is formed include a combination of polystyrene and polybutyl acrylate, a combination of polystyrene and polybutyl methacrylate, a combination of polystyrene and poly(2-ethylhexyl acrylate), a combination of polymethyl methacrylate and polybutyl methacrylate, a combination of polystyrene and polyhexyl methacrylate, a combination of polyethyl methacrylate and polyethyl acrylate, and a combination of polyisoprene and polybutylene.

The core-shell particles containing the combination exhibit the pressure plasticization behavior irrespective of which resin of the combination forms the core or shell, and for achieving the formation of toner and the durability upon transportation and storage simultaneously, the shell may be the high Tg phase.

Among these, 80% by weight or more of the resin used in the shell of the core-shell particles may be constituted by a styrene compound, whereas 80% by weight or more of the resin used in the core may be constituted by a (meth)acrylate ester compound, and 80% by weight or more of the resin used in the core is preferably constituted by an acrylate ester compound.

The resin used in the core may have a weight average molecular weight of from approximately 3,000 to approximately 50,000, and preferably from approximately 5,000 to approximately 40,000. When the weight average molecular weight is in the range, the fixing property and the image strength after fixing may be achieved simultaneously.

The resin used in the shell may have a weight average molecular weight of from approximately 3,000 to approximately 50,000, and preferably from approximately 5,000 to approximately 40,000. When the weight average molecular weight is in the range, the fixing property and the prevention of filming on a photoconductor may be achieved simultaneously.

The content of the core-shell particles may be approximately 20% or more, preferably from approximately 30 to approximately 90%, and more preferably from approximately 50 to approximately 85%, based on the total weight of the toner, for achieving the advantages of the exemplary embodiment. When the content is in the range, good pressure fixing property may be obtained.

For using the particles in an amount of 50% by weight in the composition of the toner, the controllability upon forming the toner, i.e., the controllability of the particle diameter and the particle diameter distribution, in an aqueous medium is imparted to the particles. For facilitating the control of these parameters by adding an aggregating agent, an acidic or basic polar group or an alcoholic hydroxyl group may be contained in the resin of the particles. These groups may be contained by copolymerizing a monomer having the polar group mainly with the shell component.

Examples of the acidic polar group include a carboxyl group, a sulfonic group and an acid anhydride group.

Examples of the monomer for forming the acidic polar group in the resin include an α,β-ethylenically unsaturated compound having a carboxyl group or a sulfonic group, and specific examples thereof include acrylic acid, methacrylic acid, fumaric acid, maleic acid, itaconic acid, cinnamic acid, sulfonated styrene and allylsulfosuccinic acid.

Examples of the basic polar group include an amino group, an amide group and a hydrazide group.

Examples of the monomer for forming the basic polar group in the resin include a monomer structural unit having a nitrogen atom (which may be hereinafter referred to as a nitrogen-containing monomer). Examples of the compound used as the monomer structural unit include a (meth)acrylamide compound, a (meth)acrylic hydrazide compound and an aminoalkyl(meth)acrylate compound.

As examples of the monomers, examples of the (meth) acrylamide compound include acrylamide, methacrylamide, methylacrylamide, methylmethacrylamide, dimethylacrylamide, diethylacrylamide, phenylacrylamide and benzylacrylamide.

Examples of the (meth)acrylic hydrazide compound include acrylic hydrazide, methacrylic hydrazide, acrylic methylhydrazide, methacrylic methylhydrazide, acrylic dimethylhydrazide and acrylic phenylhydrazide.

Examples of the aminoalkyl(meth)acrylate compound include 2-aminoethyl acrylate and 2-aminoethyl methacrylate. The aminoalkyl(meth)acrylate compound may be a monoalkylaminoalkyl(meth)acrylate compound or a dialkylaminoalkyl(meth)acrylate compound, and examples thereof include 2-(diethylamino)ethyl(meth)acrylate.

Examples of the monomer for forming the alcoholic hydroxyl group in the resin include a hydroxyacrylate compound, and specific examples thereof include 2-hydroxyethyl (meth)acrylate, hydroxypropyl(meth)acrylate and hydroxybutyl(meth)acrylate.

The content of the monomer having a polar group may be from approximately 0.01 to approximately 20% by weight, and preferably from approximately 0.1 to approximately 10% by weight, based on the total weight of the polymerizable monomers used in the shell. When the content is in the range, the controllability upon forming the toner in an aqueous medium may be imparted to the core-shell particles.

The polymerization reaction may be performed by using an aqueous medium.

Examples of the aqueous medium used in the exemplary embodiment include water, such as distilled water and ion exchanged water, and an alcohol, such as ethanol and methanol. Among these, ethanol and water are preferably used, and water, such as distilled water and ion exchanged water, is more preferably used. These media may be used solely or as a combination of two or more kinds thereof.

The aqueous medium may contain a water miscible organic solvent. Examples of the water miscible organic solvent include acetone and acetic acid.

The polymerization reaction may be performed by using an organic solvent.

Examples of the organic solvent used in the exemplary embodiment include a hydrocarbon solvent, such as toluene, xylene and mesitylene; a halogenated solvent, such as chlorobenzene, bromobenzene, iodobenzene, dichlorobenzene, 1,1,2,2-tetrachloroethane and p-chlorotoluene; a ketone solvent, such as 3-hexanone, acetophenone and benzophenone; an ether solvent, such as dibutyl ether, anisole, phenetol, o-dimethoxybenzene, p-dimethoxybenzene, 3-methoxytoluene, dibenzyl ether, benzyl phenyl ether, methoxynaphthalene and tetrahydrofuran; a thioether solvent, such as phenylsulfide and thioanisole; an ester solvent, such as ethyl acetate, butyl acetate, pentyl acetate, methyl benzoate, methyl phthalate, ethyl phthalate and cellosolve acetate; and a diphenyl ether solvent, such as diphenyl ether, an alkyl-substituted diphenyl ether, e.g., 4-methyldiphenyl ether, 3-methyldiphenyl ether and 3-phenoxytoluene, a halogen-substituted diphenyl ether, e.g., 4-bromodiphenyl ether, 4-chlorodiphenyl ether, and 4-methyl-4'-bromodiphenyl ether, an alkoxy-substituted diphenyl ether, e.g., 4-methoxydiphenyl ether, 3-methoxydiphenyl ether and 4-methyl-4'-methoxydiphenyl ether, and a cyclic diphenyl ether, e.g., dibenzofuran and xanthene. These solvents may be used as a mixture thereof.

The core-shell particles may have a weight ratio of the resin constituting the core and the resin constituting the shell (core/shell) of from approximately 10/90 to approximately 90/10, and preferably from approximately 15/85 to approximately 85/15. When the ratio is in the range, the pressure fixing property may be improved.

The core-shell particles may have a median diameter of from approximately ½ to approximately 1/1,000, preferably from approximately ⅕ to approximately 1/1,000, and more preferably from approximately 1/10 to approximately 1/200, with respect to the volume average particle diameter of the toner. When the median diameter is in the range, the control of the particle diameter of the toner may be facilitated.

The median diameter of the core-shell particles may be from approximately 0.01 to approximately 1.0 μm, preferably from approximately 0.05 to approximately 0.7 μm, and more preferably from approximately 0.1 to approximately 0.5 μm. When the median diameter is in the range, the control of the particle diameter distribution of the toner may be facilitated.

The median diameter of the core-shell particles may be measured by a known method, and for example, may be measured with a laser diffraction particle size distribution measuring apparatus (LA-920, available from Horiba, Ltd.)

The method for confirming that plural core-shell particles are contained in the toner is not particularly limited, and examples of the method include a method of observing the cross section of the toner with a transmission electron microscope, and a method of observing a cross section of the toner having been enhanced in contrast by dyeing or the like with a scanning electron microscope. There are cases where the fact that two or more core-shell particles are contained in the toner is clear from the ratio of the particle diameters of the toner and the core-shell particles upon production, the amount of the core-shell particles used, the production method, and the like.

The pressure plasticizing core-shell particles may be used solely as the binder resin or may be used after mixing with resin particles formed by emulsion polymerization or the like.

The proportion of the core-shell particles may be approximately 30% by weight or more, preferably from approximately 40 to 100% by weight, and more preferably from approximately 50 to 100% by weight, for achieving the advantages of the exemplary embodiment.

In the exemplary embodiment, polycondensation or polymerization reaction of a monomer and a prepolymer of a monomer having been prepared in advance may be contained. The prepolymer is not particularly limited as far as it is a polymer that is fused or mixed homogeneously in the monomer.

The binder resin used in the exemplary embodiment may be a homopolymer of the monomer, or a copolymer of two or more kinds of monomer including the aforementioned monomer, or may be a mixture thereof, a graft polymer, a polymer partly having a branch or a crosslinked structure, or the like.

The binder resin used in the exemplary embodiment may be a crosslinked resin by adding a crosslinking agent depending on necessity. Examples of the crosslinking agent include a polyfunctional monomer having two or more ethylenically polymerizable unsaturated group in one molecule.

Specific examples of the crosslinking agent include an aromatic polyvinyl compound, such as divinylbenzene and divinylnaphthalene; a polyvinyl ester of an aromatic polybasic carboxylic acid, such as divinyl phthalate, divinyl isophthalate, divinyl terephthalate, divinyl homophthalic acid, divinyl or trivinyl trimesate, divinyl naphthalenedicarboxylate and divinyl biphenylcarboxylate; a divinyl ester of a nitrogen-containing aromatic compound, such as divinyl pyridinecarboxylate; a vinyl ester of an unsaturated heterocyclic compound carboxylic acid, such as vinyl pyromucate, vinyl furancarboxylate, vinyl pyrrole-2-carboxylate and vinyl thiophenecarboxylate; a polyfunctional (meth)acrylate ester compound of a linear polyhydric alcohol, such as butanediol dimethacrylate, hexanediol diacrylate, octanediol dimethacrylate, decanediol diacrylate and dodecanediol dimethacryalte; a polyfunctional (meth)acrylate ester of a branched or substituted polyhydric alcohol, such as neopentyl glycol dimethacrylate and 2-hydroxy-1,3-diacryloxypropane; polyethylene glycol di(meth)acrylate; polypropylene glycol di(meth)acrylate; polyethylene glycol di(meth)acrylate, polypropylene polyethylene glycol di(meta)acrylate; and a polyfunctional vinyl ester of a polybasic carboxylic acid, such as divinyl succinate, divinyl fumarate, vinyl or divinyl maleate, divinyl diglycolate, vinyl or divinyl itaconate, divinyl acetonedicarboxylate, divinyl glutarate, divinyl 3,3'-thiodipropionate, divinyl or trivinyl trans-aconitate, divinyl adipate, divinyl pimelate, divinyl suberate, divinyl azelate, divinyl sebacate, divinyl dodecanedioate and divinyl brassylate.

In the exemplary embodiment, the crosslinking agent may be used solely or in combination of two or more thereof. Preferred examples of the crosslinking agent in the exemplary embodiment among the aforementioned crosslinking agent include a polyfunctional (meth)acrylate ester compound of a linear polyhydric alcohol, such as butanediol dimethacrylate, hexanediol diacrylate, octanediol dimethacrylate, decanediol diacrylate and dodecanediol dimethacryalte; a polyfunctional (meth)acrylate ester of a branched or substituted polyhydric alcohol, such as neopentyl glycol dimethacrylate and 2-hydroxy-1,3-diacryloxypropane; polyethylene glycol di(meth) acrylate; and polypropylene polyethylene glycol di(meth) acrylate.

The content of the crosslinking agent may be from approximately 0.05 to approximately 5% by weight, and preferably from approximately 0.1 to approximately 1.0% by weight, based on the total amount of the polymerizable monomers.

The binder resin used in the toner in the exemplary embodiment that is produced by radical polymerization of a polymerizable monomer may be produced by polymerization using a radical polymerization initiator.

The radical polymerization initiator used herein is not particularly limited, and specific examples thereof include a peroxide compound, such as hydrogen peroxide, acetyl peroxide, cumyl peroxide, tert-butyl peroxide, propyonyl peroxide, benzyol peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pert-riphenylacetic tert-butylhydroperoxide, tert-butyl performate, tert-butyl peracetate, tert-butyl perbenzoate, tert-butyl perphenylacetate, tert-butyl permethoxyacetate and tert-butyl per-N-(3-toluoyl)carbamate; an azo compound, such as 2,2'-asobispropane, 2,2'-dichloro-2,2'-asobispropane, 1,1'-azo(methylethyl)diacetate, 2,2'-azobis(2-aminopropane) hydrochloride, 2,2'-azobis(2-aminopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis (sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A 4,4'-azobis-4-cyanopentanoate), poly(tetraethylene glycol 2,2'-azobisisobutyrate) and 2,2'-azobis(2-methylpropiondiamine)dihydrochloride; 1,4-bis(pentaethylene)-2-tetrazene, and 1,4-dimethoxycarbonyl-1,4-diphenyl-2-tetrazene.

Upon performing polycondensation and/or polymerization in an aqueous medium for producing the binder resin, examples of the method of forming an emulsion of the monomer particles include such a method that a monomer solution containing a cosurfactant (oily phase) and an aqueous medium solution of a surfactant (aqueous phase) are homogeneously mixed with a shearing mixing device, such as a piston homogenizer, a micro-fluidizing device (e.g., Microfluidizer, available from Microfluidics Corporation) and an ultrasonic dispersing device, thereby performing emulsification. In this case, the amount of the oily phase charged with respect to the aqueous phase may be from approximately 0.1 to approximately 50% by weight based on the total amount of the aqueous phase and the oily phase. The amount of the surfactant used may be an amount less than the critical micelle concentration (CMC) in the presence of the emulsion formed, and the amount of the cosurfactant used may be from approximately 0.1 to approximately 40 parts by weight, and preferably from approximately 0.1 to approximately 20 parts by weight, per 100 parts by weight of the oily phase.

The "miniemulsion polymerization method", which is a polymerization method of a monomer, in which an emulsion of the monomer is polymerized in the presence of a polymerization initiator with the use of both a surfactant in an amount less than the critical micelle concentration (CMC) and a cosurfactant, may be employed since the addition polymerizable monomer is polymerized inside the monomer particles (oily droplets), thereby forming uniform polymer particles. In the exemplary embodiment, diffusion of a monomer in the polymerization process is unnecessary when the "miniemulsion polymerization method" is performed for a polycondensation or addition polymerization composite polymer, and thus the polycondensation polymer advantageously stays inside the polymer particles.

The "microemulsion polymerization method" with particles having a particle diameter of from 5 to 50 nm disclosed in J. S. Guo, M. S. El-Aasser, J. W. Vanderhoff, J. Polym. Sci., Polym Chem. Ed., vol. 27, p. 691 (1989), etc. has the dispersion structure and polymerization mechanism as in the "miniemulsion polymerization method" in the exemplary embodiment, and thus may be used in the exemplary embodiment. The "microemulsion polymerization method" used a larger amount of a surfactant exceeding the critical micelle concentration (CMC), and thus there may be such problems that a large amount of a surfactant may be mixed in the resulting polymer particles, a prolonged period of time may be required for removing the surfactant by a rinsing treatment with water, acid or alkali, or the like.

Upon performing polycondensation and/or polymerization in an aqueous medium for producing the binder resin, a cosurfactant may be used in an amount of from approximately 0.1 to approximately 40% by weight based on the total amount of the monomer. The cosurfactant is added for decreasing the Ostwald ripening in the so-called miniemulsion polymerization. Examples of the cosurfactant include those that are ordinarily known as a cosurfactant for miniemulsion polymerization method.

Examples of the cosurfactant include an alkane compound having from 8 to 30 carbon atoms, such as dodecane, hexadecane and octadecane; an alkyl alcohol compound having from 8 to 30 carbon atoms, such as lauryl alcohol, cetyl alcohol and stearyl alcohol; and an alkyl mercaptan compound having from 8 to 30 carbon atoms, such as lauryl mercaptan, cetyl mercaptan and stearyl mercaptan; and also include an acrylate ester or methacrylate ester and a polymer thereof, a polymer or polyadduct, such as polystyrene and polyester, a carboxylic acid compound, a ketone compound, and an amine compound, but the cosurfactant is not limited to these compounds.

Preferred examples of the cosurfactant among those shown above include hexadecane, cetyl alcohol, stearyl methacrylate, lauryl methacrylate, polyester and polystyrene. For avoiding formation of a volatile organic substance, stearyl methacrylate, lauryl methacrylate, polyester and polystyrene may be used.

The polymer and the composition containing a polymer used for the cosurfactant may contain, for example, a copolymer, a block copolymer or a mixture with another monomer. Plural kinds of the cosurfactants may be used in combination.

The cosurfactant may be added to either the oily phase or the aqueous phase.

In the production of the toner in the exemplary embodiment, a surfactant may be used for stabilizing the dispersion state in the suspension polymerization, and stabilization of the dispersion state of the resin particle dispersion liquid, the colorant particle dispersion liquid, the releasing agent particle dispersion liquid and the like in the emulsion aggregation method.

Examples of the surfactant include an anionic surfactant, such as a sulfate ester series, a sulfonate salt series, a phosphate ester series and a soap series; a cationic surfactant, such as amine salt type and a quaternary ammonium salt type; and a nonionic surfactant, such as a polyethylene glycol series, an alkylphenol ethylene oxide additive series and a polyhydric alcohol series. Preferred examples thereof among these include an ionic surfactant, and more preferred examples thereof include an anionic surfactant and a cationic surfactant.

For the toner in the exemplary embodiment, an anionic surfactant generally has large dispersion power and is excellent in dispersion of the resin particles and the colorant. As a surfactant for dispersing the releasing agent, an anionic surfactant may be used.

A nonionic surfactant may be used in combination with an anionic surfactant or a cationic surfactant. The surfactant may be used solely or in combination of two or more kinds thereof.

Specific examples of the anionic surfactant include a fatty acid soap compound, such as potassium laurate, sodium oleate and sodium salt of castor oil; a sulfate ester compound, such as octyl sulfate, lauryl sulfate, lauryl ether sulfate and nonyl ether sulfate; a sulfonate compound, such as a sodium alkylnaphthalenesulfonate, laurylsulfonate, dodecylbenzenesulfonate, triisopropylnaphthalenesulfonate and dibutylnaphthalenesulfonate; a sulfonate salt compound, such as a naphthalenesulfonate formalin condensate, monooctyl sulfosuccinate, dioctyl sulfosuccinate, lauric amide sulfonate and oleic amide sulfonate; a phosphate ester compound, such as lauryl phosphate, isopropyl phosphate and nonyl phenyl ether phosphate; a dialkyl sulfosuccinate salt compound, such as sodium dioctyl sulfosuccinate; and a sulfosuccinate salt compound, such as disodium lauryl sulfosuccinate.

Specific examples of the cationic surfactant include an amine salt compound, such as laurylamine hydrochloride, stearylamine hydrochloride, oleylamine acetate, stearylamine acetate and stearylaminopropylamine acetate; and a quaternary ammonium salt compound, such as lauryltrimethylammonium chloride, dilauryldimethylammonium chloride, distearyldimethylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenetrimethylammonium chloride, alkyltrimethylammonium chloride and tetradecyltrimethylammonium bromide (TTAB).

Specific examples of the nonionic surfactant include an alkyl ether compound, such as polyoxyethylene octyl ether, polyoxyethylene lauryl ether, polyoxyethylene stearyl ether and polyoxyethylene oleyl ether; an alkyl phenyl ether compound, such as polyoxyethylene octyl phenyl ether and polyoxyethylene nonyl phenyl ether; an alkyl ester compound, such as polyoxyethylene laurate, polyoxyethylene stearate and polyoxyethylene oleate; an alkylamine compound, such as polyoxyethylene laurylamino ether, polyoxyethylene stearylamono ether, polyoxyethylene oleylamino ether, polyoxyethylene soybean amino ether and polyoxyethylene beef tallow amino ether; an alkylamide compound, such as polyoxyethylene lauric acid amide, polyoxyethylene stearic acid amide and polyoxyethylene oleic acid amide; a vegetable oil ether compound, such as polyoxyethylene castor oil ether and polyoxyethylene rapeseed oil ether; an alkanol amide compound, such as lauric acid diethanolamide, stearic acid diethanolamide and oleic acid diethanolamide; a sorbitan ester ether compound, such as polyoxyethylene sorbitan monolaurate, polyoxyethylene sorbitan monopalmiate, polyoxyethylene sorbitan monostearate and polyoxyethylene sorbitan monooleate.

The content of the surfactant in the dispersion liquids may be such an amount that does not impair the advantages of the exemplary embodiment, which is generally a small amount, and specifically may be from approximately 0.01 to approximately 3% by weight, preferably from approximately 0.05 to approximately 2% by weight, and more preferably from approximately 0.1 to approximately 2% by weight. When the content is in the range, the dispersion liquids, such as the resin particle dispersion liquid, the colorant particle dispersion liquid and the releasing agent particle dispersion liquid, are stable without aggregation or release of certain particles, thereby providing sufficiently the advantages of the exemplary embodiment. In general, a suspension polymerization toner dispersion having a large particle diameter is stable even with a small amount of a surfactant.

Examples of the dispersion stabilizer used in the suspension polymerization method or the like include inorganic fine powder that is difficultly soluble in water and is hydrophilic. Examples of the inorganic fine powder used include silica, alumina, titania, calcium carbonate, magnesium carbonate, tricalcium phosphate (hydroxyapatite), clay, diatom earth and bentonite. Preferred examples among these from the standpoint of easiness in particle size formation of fine particles and removal thereof include calcium carbonate and tricalcium phosphate.

An aqueous polymer or the like that is in a solid state at ordinary temperature may also be used as the dispersion stabilizer. Specific examples thereof include a cellulose compound, such as carboxymethyl cellulose and hydroxypropyl cellulose, polyvinyl alcohol, gelatin, starch and gum arabic.

Block Copolymer Having Low Tg Polyester Block and High Tg Polyester Block

In the exemplary embodiment, for imparting the pressure plasticization effect represented by the expression (1) to the toner, a block copolymer may be used as the binder resin.

The block copolymer may contain other block than the low Tg polyester block and the high Tg polyester block, and is preferably a block copolymer containing the low Tg polyester block and the high Tg polyester block.

The block copolymer containing the low Tg resin and the high Tg resin shows a plasticization behavior to pressure and exhibits flowability within ordinary temperature range at a certain pressure or more. The plasticization flowing behavior is accelerated under heating to a certain extent, and thus it is considered that the resin flowability required for fixing under lower pressure is obtained.

In the exemplary embodiment, a block copolymer containing a crystalline polyester block and a non-crystalline polyester block may be used, which is imparted with flowability at a certain pressure or more, but behaves as a solid matter at a pressure lower than the certain pressure. Accordingly, high reliability is ensured in operations other than pressure fixing, i.e., developing, transferring, cleaning and the like.

In particular, since a plasticization flowing behavior is obtained under pressure, the toner may be favorably applied to heavy paper, which suffers fluctuation in temperature upon fixing. The fixing operation to heavy paper, which has been difficult to perform at high speed and thus has been performed with a decreased fixing speed or an increased heating temperature, can be thus performed with a fixing speed and a temperature that are equivalent to the fixing operation to thin paper.

The block copolymer containing a crystalline polyester block and a non-crystalline polyester block may be provided in any method. Specific examples of the method include a method of mixing a crystalline polyester resin and a non-crystalline polyester resin and performing polymer reaction, a method of mixing a monomer for forming a non-crystalline polyester resin with a crystalline polyester resin and performing polymerization, and a method of mixing a monomer for forming a crystalline polyester resin with a non-crystalline polyester resin and performing polymerization. Preferred examples of the method among these include a method of mixing a crystalline polyester resin and a non-crystalline polyester resin and performing polymer reaction, thereby providing the block copolymer.

The block copolymer may be obtained by polymerization at 150° C. or less with a Bronsted acid containing sulfur atom as a catalyst, thereby providing the block copolymer with less energy.

The crystalline polyester block (crystalline polyester resin) and the non-crystalline polyester block (non-crystalline polyester resin) used in the exemplary embodiment may be produced, for example, by direct esterification reaction, ester exchange reaction or the like in an aqueous medium, using polycondensation monomers, such as an aliphatic, alicyclic or aromatic polybasic carboxylic acid or an alkyl ester thereof, a polyhydric alcohol or an ester compound thereof, and a hydroxycarboxylic acid.

Polycondensation Monomer

The polybasic carboxylic acid used as a polycondensation monomer for providing the crystalline polyester block and the non-crystalline polyester block is a compound that has two or more carboxyl groups per one molecule. A dicarboxylic acid is a compound having two carboxyl groups per one molecule, and examples thereof include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexan-3,5-diene-1,2-(di)carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenyl-p,p'-dicarboxylic acid, napthalene-1,4-dicarboxylic acid, napthalene-1,5-dicarboxylic acid, napthalene-2,6-dicarboxylic acid, anthracenedicarboxylic acid and cyclohexanedicarboxylic acid. Examples of the polybasic acid other than a dicarboxylic acid include trimellitic acid, pyromellitic acid, naphthalenetricarboxylic acid, naphthalenetetracarbocylic acid, pyrenetricarboxylic acid and pyrenetetracarboxylic acid. Derivatives of the carboxyl group of the carboxylic acids, such as an anhydride, a mixed anhydride, an acid chloride and an ester, may also be used.

The polyol used in the exemplary embodiment is a compound that has two or more hydroxyl groups per one molecule. A diol is a compound having two hydroxyl groups per one molecule, and examples thereof include ethylene glycol, propylene glycol, butanediol, diethylene glycol, hexanediol, cyclohexanediol, octanediol, decanediol and dodecanediol. Examples of the polyol other than a diol include glycerin, pentaerythritol, hexamethylolmelamine, hexaethylolmelamine, tetramethylolbenzoguanamine and tetraethylolbenzoguanamine.

The polyol is difficultly soluble or insoluble in an aqueous medium, and thus the ester formation reaction proceeds inside the monomer droplets formed by dispersing the polyol in an aqueous medium.

Examples of the hydroxycarboxylic acid used as a polycondensation monomer for the polyester in the exemplary embodiment include hydroxyheptanoic acid, hydroxyoctanoic acid, hydroxydecanoic acid and hydroxyundecanoic acid.

The non-crystalline polyester and the crystalline polyester used in the exemplary embodiment can be easily produced with a combination of the polycondensation monomers.

Examples of the polybasic carboxylic acid used for providing the crystalline polyester include, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaric acid, n-dodecylsuccinic acid, n-dedecenylsuccinic acid, isododecylsuccinic acid, isododecenylsuccinic acid, n-octylsuccinic acid, n-octenylsuccinic acid, and anhydrides and acid chlorides of these acids.

Examples of the polyol used for providing the crystalline polyester include ethylene glycol, diethylene glycol, triethylene glycol, 1,2-propylene glycol, 1,3-propylene glycol, 1,4-butanediol, 1,4-butenediol, neopentyl glycol, 1,5-pentaneglycol, 1,6-hexaneglycol, 1,4-cyclohexanediol, 1,4-cyclohexanedimethanol, dipropylene glycol, polyethylene glycol and polypropylene glycol.

A crystalline polyester obtained by ring-opening polymerization of a cyclic monomer, such as caprolactone, may be used since the polyester has a crystal melting point around 60° C., which is suitable for a toner.

Examples of the crystalline polycondensation resin include a polyester obtained by reacting 1,9-nonanediol and 1,10-decanedicarboxylic acid, a polyester obtained by reacting cyclohexanediol and adipic acid, a polyester obtained by reacting 1,6-hexanediol and sebacic acid, a polyester obtained by reacting ethylene glycol and succinic acid, a polyester obtained by reacting ethylene glycol and sebacic acid, and a polyester obtained by reacting 1,4-butanediol and succinic acid. Preferred examples thereof among these include a polyester obtained by reacting 1,9-nonanediol and 1,10-decanedicarboxylic acid, and a polyester obtained by reacting 1,6-hexanediol and sebacic acid.

Non-Crystalline Polyester

Examples of the polybasic carboxylic acid used for providing the non-crystalline polyester in the exemplary embodiment include, among the aforementioned polybasic carboxylic acids, such dicarboxylic acids as phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenes diglycolic acid, diphenyl-p,p'-dicarboxylic acid, napthalene-1,4-dicarboxylic acid, napthalene-1,5-dicarboxylic acid, napthalene-2,6-dicarboxylic acid, anthracenedicarboxylic acid and cyclohexanedicarboxylic acid. Examples of the polybasic acid other than a dicarboxylic acid include trimellitic acid, pyromellitic acid, naphthalenetricarboxylic acid, naphthalenetetracarbocylic acid, pyrenetricarboxylic acid and pyrenetetracarboxylic acid. Derivatives of the carboxyl group of the carboxylic acids, such as an anhydride, an acid chloride and an ester, may also be used.

Preferred examples among these include terephthalic acid and a lower ester thereof and cyclohexanedicarboxylic acid. The term lower ester herein means an ester of an aliphatic alcohol having from 1 to 8 carbon atoms.

Examples of the polyol used for providing the non-crystalline polyester in the exemplary embodiment include, among the aforementioned polyols, polytetramethylene glycol, bisphenol A, bisphenol Z, hydrogenated bisphenol A and cyclohexanedimethanol.

A polycondensation product of a hydroxycarboxylic acid may be used as the non-crystalline resin. A hydroxycarboxylic acid is a compound that has both a hydroxyl group and a carboxyl group in the molecule. Examples of the hydroxycarboxylic acid include an aromatic hydroxycarboxylic acid and an aliphatic hydroxycarboxylic acid, and preferred examples thereof include an aliphatic hydroxycarboxylic acid.

Specific examples of the aliphatic hydroxycarboxylic acid include hydroxyheptanoic acid, hydroxyoctanoic acid, hydroxydecanoic acid, hydroxyundecanoic acid and lactic acid, and preferred examples among these include lactic acid.

The non-crystalline resin and the crystalline resin can be easily produced with a combination of the polycondensation monomers.

One kind of the polybasic carboxylic acid and one kind of the polyol each may be used solely for producing one kind of the polycondensation resin, and one kind for one of them and two or more kinds for the other or two or more kinds for each of the both may be used. In the case where the hydroxycarboxylic acid is used for producing one kind of the polycondensation resin, the hydroxycarboxylic acid may be used solely or in combination of two or more thereof, and a polybasic carboxylic acid and a polyol may be used in combination.

The weight ratio of the crystalline polyester block and the non-crystalline polyester block in the block copolymer, crystalline polyester block/non-crystalline polyester block, may be from approximately 1/20 to approximately 20/1, preferably from approximately 1/10 to approximately 10/1, and more preferably from approximately 1/9 to approximately 5/5. When the weight ratio of the crystalline polyester block and the non-crystalline polyester block is in the range, deterioration of the charging property of the toner due to the crystalline polyester may be suppressed. When the weight ratio is in the range, the block copolymer constituting the toner has sufficient charging property and mechanical strength, is excellent in low temperature fixing property, and is excellent in flowing behavior under pressure.

In the case where the block copolymer is produced by mixing the crystalline polyester resin and the non-crystalline polyester resin through polymer reaction, the crystalline polyester resin may have a crystal melting point of from approximately 40 to approximately 150° C., preferably from approximately 50 to approximately 120° C., and more preferably from approximately 50 to approximately 90° C. When the crystal melting point of the crystalline resin used is in the range, the resulting toner has good blocking resistance, provides good melt flowability at low temperature, and is good in fixing property.

The melting point of the crystalline polyester resin may be measured according to differential scanning calorimetry (DSC), for example, with "DSC-20" (available from Seiko Instruments & Electronics Ltd.), and may be specifically obtained as a melting peak temperature in the input-compensated differential scanning calorimetry according to JIS K7121-87, in which approximately 10 mg of a specimen is measured by increasing the temperature from room temperature to 150° C. at a constant temperature increasing rate of 10° C. per minute. A crystalline resin may exhibit plural melting peaks in some cases, and in the exemplary embodiment, the maximum peak is designated as the melting point.

In the case where the block copolymer is produced by mixing the crystalline polyester resin and the non-crystalline polyester resin through polymer reaction, the non-crystalline polyester resin may have a glass transition temperature Tg of from approximately 50 to approximately 80° C., and preferably from approximately 50 to approximately 65° C. When the Tg is approximately 50° C. or more, the binder resin is good in aggregation power by itself at high temperature, and hot-offset may be hard to occur upon fixing, and when the Tg is approximately 80° C. or less, the resin is sufficiently melted, and an increase of the minimum fixing temperature may not occur.

The glass transition temperature of the non-crystalline resin is a value that is measured by a method according to ASTM D3418-82 (DSC method).

The glass transition temperature in the exemplary embodiment may be measured with a differential scanning calorimetry (DSC), for example, with "DSC-20" (available from Seiko Instruments & Electronics Ltd.), and may be specifically obtained as an intersecting point of the baseline and the endothermic peak upon heating approximately 10 mg of a specimen at a constant temperature increasing rate of 10° C. per minute.

In the exemplary embodiment, the glass transition temperature of the block copolymer may be from approximately 50 to approximately 80° C., and preferably from approximately 50 to approximately 65° C. When the glass transition temperature of the block copolymer is in the range, the toner may be prevented from forming a cake, and may be enhanced in storage stability.

The melting point of the block copolymer may be from approximately 50 to approximately 100° C., and preferably from approximately 50 to approximately 80° C. When the melting point of the block copolymer is in the range, the fixing property to heavy paper, the charging property, the filming durability to a photoconductor, and the like may be achieved simultaneously.

There are cases where the block copolymer does not have a melting point and a glass transition temperature that are clearly observed.

In the case where the block copolymer is obtained by mixing the crystalline polyester resin and the non-crystalline polyester resin through polymer reaction, the crystalline polyester resin to be mixed may have a weight average molecular weight of from approximately 1,000 to approximately 100,000, and preferably from approximately 1,500 to approximately 10,000. The non-crystalline polyester resin to be mixed may have a weight average molecular weight of from approximately 1,000 to approximately 100,000, and preferably from approximately 2,000 to approximately 10,000.

In the exemplary embodiment, the block copolymer may have a weight average molecular weight of from approximately 5,000 to 500,000, and preferably from approximately 5,000 to approximately 50,000.

The block copolymer used in the exemplary embodiment may partially have branches and crosslinking through selection of the numbers of valence of carboxylic acid and alcohol of the monomers, addition of a crosslinking agent, or the like.

The crystalline and non-crystalline polyester resins may be produced by subjecting the polyhydric alcohol and the polybasic carboxylic acid to polycondensation reaction according to an ordinary method. The polycondensation reaction may be performed by an ordinary polycondensation method, such as bulk polymerization, emulsion polymerization, polymerization in water, such as suspension polymerization, solution polymerization, and interface polymerization, and bulk polymerization is preferably employed. The polycondensation reaction may be performed under the atmospheric pressure, and may be performed under ordinary conditions, such as under reduced pressure or in a nitrogen stream, for such purposes as production of polyester molecules having a high molecular weight.

Specifically, for example, the polyhydric alcohol and the polybasic carboxylic acid, and a catalyst depending on necessity, are placed and mixed in a reaction vessel equipped with a thermometer, a stirrer and a falling condenser, and heated in the presence of an inert gas (such as nitrogen gas), low molecular weight compounds by-produced are removed continuously to the exterior of the reaction system, the reaction is terminated at the time when the prescribed acid value is obtained, and the reaction system is cooled, thereby providing the target reaction product.

At least one of the crystalline polyester resin and the non-crystalline polyester resin may be produced by polymerization in the presence of a Bronsted acid catalyst containing sulfur at approximately 150° C. or less, and both the crystalline polyester resin and the non-crystalline polyester resin are preferably produced by polymerization in the presence of a Bronsted acid catalyst containing sulfur at approximately 150° C. or less.

The block copolymer may be produced by adding a Bronsted acid catalyst containing sulfur as a catalyst to the crystalline polyester resin and the non-crystalline polyester resin, which are heated to approximately 150° C. or less.

The reaction temperature is preferably from approximately 70 to approximately 150° C., and more preferably from approximately 80 to approximately 140° C.

When the reaction temperature is approximately 70° C. or more, reduction of reactivity due to reduction of solubility of the monomers and reduction of the catalyst activity does not occur, thereby avoiding the prevention of increase of the molecular weight. When the reaction temperature is approximately 150° C. or less, the block copolymer may be produced with low energy, and furthermore, coloration of the resulting resin and decomposition of the polyesters thus produced can be prevented from occurring.

Polycondensation Catalyst

Bronsted Acid Catalyst Containing Sulfur

Examples of the Bronsted acid catalyst containing sulfur include an alkylbenzenesulfonic acid, such as dodecylbenzenesulfonic acid, isopropylbenzenesulfonic acid and camphor sulfonic acid, an alkylsulfonic acid, an alkyldisulfonic acid, an alkylphenolsulfonic acid, an alkylnaphthalenesulfonic acid, an alkyltetralinsulfonic acid, an alkylallylsulfonic acid, a petroleum sulfonic acid, an alkylbenzimidazolesulfonic acid, a higher alcohol ether sulfonic acid, an alkyldiphenylsulfonic acid, a higher fatty acid sulfate ester, such as monobutylphenylphenol sulfate, dibutylphenylphenol sulfate, and dodecyl sulfate a higher alcohol sulfate ester, a higher alcohol ether sulfate ester, a higher fatty acid amide alkylol sulfate ester, a higher fatty acid amide alkylated sulfate ester, naphthenyl alcohol sulfate, a sulfated fat, a sulfosuccinate ester, a sulfonated higher fatty acid, resin acid alcohol sulfate, and salt compounds of all the compounds, but the exemplary embodiment is not limited to these examples. The catalyst may have a functional group in the structure thereof. The catalyst may be used in combination of two or more kinds thereof. Preferred examples of the Bronsted acid catalyst containing sulfur include an alkylbenzenesulfonic acid, and particularly preferred examples thereof include dodecylbenzenesulfonic acid, benzensulfonic acid, p-toluenesulfonic acid and camphor sulfonic acid.

Other Polycondensation Catalyst

Other polycondensation catalysts that are ordinarily used may be used in addition to the aforementioned catalyst. Specific examples of the catalyst include a metallic catalyst, a hydrolase catalyst, a basic catalyst and a Bronsted acid catalyst containing no sulfur.

Other Binder Resin

In the exemplary embodiment, the toner may contain other binder resin than the core/shell particles and/or the block copolymer as the binder resin.

Examples of the other binder resin include an ethylene resin, a styrene resin, a polymethyl methacrylate resin, a (meth)acrylic resin, a polyamide resin, a polycarbonate resin, a polyether resin, a polyester resin and copolymer resins thereof, and preferred examples thereof include a styrene resin, a (meth)acrylic resin, a polyester resin and copolymer resins thereof.

Examples of the polyester resin include the polyesters used in the core/shell particles. Examples of the production method of the polyester resin include known synthesis methods disclosed in "Jushukugo" (Polycondensation) (published by Kagaku-Dojin Publishing Co., Inc. (1971)), "Kobunshi Jikken Gaku (Jushukugo to Jufuka)" (Polymer Experiments (Polycondensation and Polyaddition)) (published by Kyoritsu Shuppan Co., Ltd. (1958)), "Polyester Jushi Handbook" (Polyester Resin Handbook) (published by Nikkan Kogyo Shimbun, Ltd. (1988) and the like, and the polyester resin may be synthesized by an ester exchange method or a direct Polycondensation method, or by a combination thereof.

An addition polymerization resin may be useful as the other binder resin used in the exemplary embodiment. Examples of the addition polymerizable monomer used for producing the addition polymerization resin include a radical polymerizable monomer, a cationic polymerizable monomer and an anionic polymerizable monomer, preferred examples thereof include a radical polymerizable resin, and more preferred examples thereof include an ethylenic unsaturated monomer. Examples of the radical polymerization resin include a styrene resin and a (meth)acrylic resin, and preferred examples thereof include a styrene-(meth)acrylic copolymer resin.

Preferred examples of the styrene-(meth)acrylic copolymer resin include a latex of a copolymer, which is obtained by polymerizing a monomer mixture containing from approximately 60 to approximately 90 parts by weight of an aromatic monomer having an ethylenically unsaturated group (styrene monomer), from approximately 10 to approximately 40 parts by weight of an ethylenic unsaturated carboxylic acid ester monomer ((meth)acrylate ester monomer) and from approximately 1 to approximately 3 parts by weight of an ethylenic unsaturated acid monomer, which is stabilized as dispersion with a surfactant. The copolymer may have a glass transition temperature of from approximately 50 to approximately 70° C.

Preferred examples of the polymerizable monomer used for producing the other binder resin used in the exemplary embodiment will be described below.

Examples of the styrene monomer include styrene, vinylnaphthalene, an alkyl-substituted styrene having an alkyl chain, such as 2-methylstyrene, 3-methylstyrene, 4-methylstyrene, 2-ethylstyrene, 3-ethylstyrene and 4-ethylstyrene, a halogen-substituted styrene, such as 2-chlorostyrene, 3-chlorostyrene and 4-chlorostyrene, and a fluorine-substituted styrene, such as 4-fluorostyrene and 2,5-difluorostyrene. Preferred examples of the styrene monomer include styrene.

Examples of the (meth)acrylate ester monomer include methyl(meth)acrylate, ethyl(meth)acrylate, n-propyl(meth)acrylate, n-butyl(meth)acrylate, n-pentyl(meth)acrylate, n-hexyl(meth)acrylate, n-heptyl(meth)acrylate, n-octyl(meth)acrylate, n-decyl(meth)acrylate, n-dodecyl(meth)acrylate, n-lauryl(meth)acrylate, n-tetradecyl(meth)acrylate, n-hexadecyl(meth)acrylate, n-octadecyl(meth)acrylate, isopropyl(meth)acrylate, isobutyl(meth)acrylate, t-butyl(meth)acrylate, isopentyl(meth)acrylate, amyl(meth)acrylate, neopentyl(meth)acrylate, isohexyl(meth)acrylate, isoheptyl(meth)acrylate, isooctyl(meth)acrylate, 2-ethylhexyl(meth)acrylate, phenyl(meth)acrylate, biphenyl(meth)acrylate, diphenylethyl(meth)acrylate, t-butylphenyl(meth)acrylate, terphenyl(meth)acrylate, cyclohexyl(meth)acrylate, t-butylcyclohexyl(meth)acrylate, dimethylaminoethyl(meth)acrylate, diethylaminoethyl(meth)acrylate, methoxyethyl(meth)acrylate, 2-hydroxyethyl(meth)acrylate, β-carboxyethyl(meth)acrylate, (meth)acrylonitrile and (meth)acrylamide. Preferred examples of the (meth)acrylate ester monomer include n-butyl(meth)acrylate.

The expression "(meth)acrylate ester" herein is an abbreviated expression that means that the compound may have either one of a methacrylate ester structure or an acrylate ester structure.

Examples of the ethylenic unsaturated acid monomer include an ethylenic unsaturated monomer containing an acidic group, such as a carboxyl group, a sulfonic acid group and an acid anhydride group.

In the case where a carboxyl group is to be contained in the styrene resin, the (meth)acrylate ester resin and the styrene-(meth)acrylate ester copolymer resin, the carboxyl group may be contained by copolymerization with a polymerizable monomer having a carboxyl group.

Specific examples of the carboxyl group-containing polymerizable monomer include acrylic acid, aconitic acid, atropic acid, allylmalonic acid, angelic acid, isocrotonic acid, itaconic acid, 10-undecenoic acid, elaidic acid, erucic acid, oleic acid, o-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl)acrylic acid, bromocinnamic acid, bromofumaric acid, bromomaleic acid, benzylidenemalonic acid, zenzoylcrylic acid, 4-pentenoic acid, maleic acid, mesaconic acid, methacrylic acid, methylcinnamic acid and methoxycinnamic acid, preferred examples thereof from the standpoint of easiness in formation of polymers include acrylic acid, methacrylic acid, maleic acid, cinnamic acid and fumaric acid, and more preferred examples thereof include acrylic acid.

The addition polymerization resin used as the other binder resin may have a weight average molecular weight of from approximately 5,000 to approximately 50,000, and preferably from approximately 8,000 to approximately 40,000.

When the molecular weight is in the range, the powder property of the toner under ordinary temperature and ordinary pressure may be maintained favorably, and a fixed image may be prevented from suffering offset upon fixing.

The other binder resin may have a glass transition temperature of from approximately 45 to approximately 65° C., and preferably from approximately 50 to approximately 65° C.

When the glass transition temperature is in the range, deterioration in powder property due to a releasing agent may be prevented from occurring, and a releasing agent can be facilitated to ooze upon fixing.

Other components used in the toner of the exemplary embodiment will be described below.

Charge Controlling Agent

In the exemplary embodiment, the toner may contain a charge controlling agent depending on necessity.

The charge controlling agent used may be a known one, and examples thereof include an azo metal complex compound, a metallic complex compound of a salicylic acid, and a resin type charge controlling agent having a polar group. Upon producing the toner by a wet method, a material that is difficultly soluble in water may be used from the standpoint of control of the ion intensity (%) and reduction in contamination with waste water. In the exemplary embodiment, the toner may be either a magnetic toner containing a magnetic material or a non-magnetic toner containing no magnetic material.

Aggregating Agent

In the case where the toner is produced by an emulsion aggregation and integration method in the exemplary embodiment, particles may be prepared by causing aggregation by change in pH in the aggregation step. Simultaneously, an aggregating agent may be added for stabilizing the aggregation of the particles and for providing aggregated particles rapidly or aggregated particles having a narrow particle size distribution.

Examples of the aggregated particles include a compound having a monovalent or higher valence of charge, and specific examples of the compound include the water soluble surfactants, such as an ionic surfactant and a nonionic surfactant, described hereinabove, an acid, such as hydrochloric acid, sulfuric acid, nitric acid, acetic acid and oxalic acid, a metal salt of an inorganic acid, such as magnesium chloride, sodium chloride, aluminum chloride (including polyaluminum chloride), aluminum sulfate, calcium sulfate, ammonium sulfate, aluminum nitrate, silver nitrate, copper sulfate and sodium carbonate, a metal salt of an fatty acid or an aromatic acid, such as sodium acetate, potassium formate, sodium oxalate, sodium phthalate and potassium salicylate, a metal salt of a phenol compound, such as sodium phenolate, a metal salt of an amino acid, and an inorganic acid salt of an aliphatic or aromatic amine compound, such as triethanolamine hydrochlorate and aniline hydrochlorate.

A metal salt of an inorganic acid is preferably used as the aggregating agent from the standpoint of the stability of the aggregated particles, the stability of the aggregating agent to heat and lapse of time, and the removal upon rinsing. Specific examples thereof include magnesium chloride, sodium chloride, aluminum chloride (including polyaluminum chloride), aluminum sulfate, ammonium sulfate, aluminum nitrate, silver nitrate, copper sulfate and sodium carbonate.

The amount of the aggregating agent added varies depending on the valence of charge and is a small amount in any case, and the amount is approximately 3% by weight or less for the monovalent compound, approximately 1% by weight or less for the divalent compound, and approximately 0.5% by weight or less for the trivalent compound, based on the total amount of the toner. The amount of the aggregating agent is favorably as small as possible, and thus a compound having a high valency of charge may be preferably used.

Colorant

The colorant used in the exemplary embodiment is not particularly limited, and the colorant may be a known colorant without particular limitation and may be selected appropriately depending on the purpose. The colorant may be used solely or as a mixture of two or more kinds thereof. Colorants that each belong different series may be used as a mixture. The colorant may be subjected to a surface treatment.

Examples of the colorant include black, yellow, orange, red, blue, violet, green and white colorants shown below.

Examples of a black pigment include organic and inorganic colorants, such as carbon black, aniline black, activated carbon, non-magnetic ferrite and magnetite.

Examples of a yellow pigment include chrome yellow, zinc yellow, yellow calcium oxide, cadmium yellow, fast yellow, fast yellow 5G, fast yellow 5GX, fast yellow 10G, benzidine yellow G, benzidine yellow GR, indanthrene yellow, quinoline yellow and permanent yellow NCG.

Examples of an orange pigment include red chrome yellow, molybdenum orange, permanent orange GTR, pyrazolone orange, vulcan orange, benzidine orange G, indanthrene brilliant orange RK and indanthrene brilliant orange GK.

Examples of a red pigment include red iron oxide, cadmium red, red lead oxide, mercury sulfide, watchyoung red, permanent red 4R, lithol red, brilliant carmine 3B, brilliant carmine 6B, dupont oil red, pyrazolone red, rhodamine B lake, lake red C, rose bengal, eosin red and alizarine lake.

Examples of a blue pigments include organic and inorganic colorants, such as iron blue, cobalt blue, alkaline blue lake, victoria blue lake, fast sky blue, indanthrene blue BC, ultramarine blue, phthalocyanine blue and phthalocyanine green.

Examples of a violet pigment include organic and inorganic colorants, such as manganese violet, fast violet B and methyl violet lake.

Examples of a green pigment include organic and inorganic colorants, such as chromium oxide, chromium green, pigment green B, malachite green lake and final yellow green G.

Examples of a white pigment include zinc white, titanium oxide, antimony white and zinc sulfide.

Examples of a body pigment include barytes, barium carbonate, clay, silica, white carbon, talc and alumina white.

Method of Dispersing Colorant

In the exemplary embodiment, the colorant in the toner is dispersed in the binder resin according to a known method. When the toner is produced by a kneading and pulverizing method, the colorant may be used as it is, or may be used as a so-called master batch obtained by dispersing the colorant in a resin to a high concentration, which is kneaded with the binder resin upon kneading, or the colorant may be dispersed in the resin in a state of a wet cake before drying, i.e., flashing after colorant synthesis.

The colorant may be used as it is for producing the toner by a suspension polymerization method, in which the colorant dispersed in the resin is dissolved or dispersed in the polymerizable monomer, thereby dispersing the colorant in the particles thus formed.

In the case where the toner is produced by an emulsion aggregation method, the colorant may be dispersed in an aqueous medium through mechanical impact or the like with a dispersant, such as a surfactant, thereby preparing a colorant dispersion liquid, which is aggregated along with the resin particles and the like to produce the toner particles.

Specific examples of the device for dispersing the colorant through mechanical impact or the like to prepare the dispersion liquid of the colorant particles include a rotation shearing homogenizer, a media dispersing device, such as a ball mill, a sand mill and an attritor, and a high-pressure counter collision dispersing device. The colorant may be dispersed in an aqueous system with a homogenizer by using a surfactant having polarity.

The colorant may be added to the toner in an amount of from approximately 4 to approximately 15% by weight, and preferably from approximately 4 to approximately 10% by weight, based on the total solid weight of the toner in order to secure coloring property upon fixing. In the case where a magnetic material is used as a black colorant, the amount thereof may be from approximately 12 to approximately 48% by weight, and preferably from approximately 15 to approximately 40% by weight. Toners of various colors including a yellow toner, a magenta toner, a cyan toner, a black toner, a white toner, a green toner and the like can be produced by selecting the colorants appropriately.

Releasing Agent

In the exemplary embodiment, the toner may contain a releasing agent depending on necessity. The releasing agent is generally used for enhancing the releasing property.

Specific examples of the releasing agent include a low molecular weight polyolefin compound, such as polyethylene, polypropylene and polybutene; a long-chain fatty acid, such as palmitic acid; a silicone compound having a softening point upon heating; a fatty acid amide compound, such as oleic amide, erucic amide, recinoleic amide and stearic amide; vegetable wax, such as carnauba wax, rice wax, candelilla wax, haze wax and jojoba oil; animal wax, such as bees wax; mineral or petroleum wax, such as montan wax, ozokerite, ceresin, paraffin wax, microcrystalline wax and Fischer-Tropsch wax; and ester wax, such as a fatty acid ester, a montanate ester and a carboxylate ester. In the exemplary embodiment, the releasing agent may be used solely or in combination of two or more kinds thereof.

The amount of the releasing agent added may be from approximately 1 to approximately 20% by weight, and preferably from approximately 5 to approximately 15% by weight, based on the total amount of the toner particles. When the amount is in the range, the advantage of the releasing agent can be obtained sufficiently, and the toner particles are difficult to be broken in a developing device, whereby the releasing agent may not be spent to a carrier to prevent the charge from being reduced.

Magnetic Material

In the exemplary embodiment, the toner may contain a magnetic material depending on necessity.

Examples of the magnetic material include a metal exhibiting ferromagnetism, an alloy thereof, a compound containing the metal, such as ferrite, magnetite, iron, cobalt, and nickel an alloy that does not contain a ferromagnetic element but exhibits ferromagnetism through appropriate heat treatment, such as an alloy referred to as a Heusler alloy, e.g., a manganese-copper-aluminum alloy and a manganese-copper-tin alloy, chromium dioxide, and the like. In the case where a black toner is to be obtained, magnetite may be used, which has black color by itself and functions as a colorant. In the case where a color toner is to be obtained, a magnetic material that is less black, such as iron oxide, may be used. Some of the magnetic materials function as a colorant, and in this case, the magnetic material may be used as a colorant. The content of the magnetic material may be from approximately 20 to approximately 70 parts by weight, and preferably from approximately 40 to approximately 70 parts by weight, per 100 parts by weight of the toner, upon producing a magnetic toner.

Internal Additive

In the exemplary embodiment, an internal additive may be added to the interior of the toner. The internal additive is generally used for the purpose of controlling the viscoelasticity of the fixed image.

Specific examples of the internal additive include inorganic particles, such as silica and titania, and organic particles, such as polymethyl methacrylate, which may be subjected to a surface treatment for enhancing the dispersibility. The internal additive may be used solely or in combination of two or more kinds thereof.

External Additive

In the exemplary embodiment, an external additive, such as a fluidizer and a charge controlling agent, may be added to the toner.

Examples of the external additive used include known materials including inorganic particles, such as silica particles having a surface treated with a silane coupling agent or the like, titanium oxide particles, alumina particles, cerium oxide particles and carbon black, polymer particles, such as polycarbonate, polymethyl methacrylate and a silicone resin, an amine metal salt, and a salicylic acid metal complex. The external additive used in the exemplary embodiment may be used solely or in combination of two or more kinds thereof.

Shape of Toner

In the exemplary embodiment, the toner may have an accumulated volume average particle diameter D50 of from approximately 3.0 to approximately 9.0 μm and preferably from approximately 3.0 to approximately 7.0 μm. When D50 is approximately 3.0 μm or more, appropriate adhesion strength is obtained, and good developing property is obtained. When D50 is approximately 9.0 μm or less, the resulting image is excellent in resolution.

In the exemplary embodiment, the toner may have a volume average particle size distribution index GSDv of approximately 1.30 or less. When GSDv is approximately 1.30 or less, good resolution is obtained, scattering of the toner and fogging are difficult to occur, and image defects are difficult to occur.

In the exemplary embodiment, the accumulated volume average particle diameter D50 and the average particle size distribution index of the toner may be measured, for example, in the following manner. Based on a particle size distribution measured with such a measuring device as Coulter Counter TA II (available from Beckman Coulter, Inc.) or Multisizer II (available from Beckman Coulter, Inc.), accumulated distributions of volume and number are each drawn from the small diameter side with respect to the divided particle size ranges (channels). The particle diameters where the accumulated value is 16% are designated as volume $D_{16V}$ and number $D_{16P}$, the particle diameters where the accumulated value is 50% are designated as volume $D_{50V}$ and number $D_{50P}$, and the particle diameters where the accumulated value is 84% are designated as volume $D_{84V}$ and number $D_{84P}$. By using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

The toner may have a shape factor SF1 of from approximately 110 to approximately 140, and preferably from approximately 120 to approximately 140. In a transferring step in an electrophotographic process, it is known that a spherical toner is liable to be easily transferred, and a toner with an irregular shape is liable to be easily cleaned in a cleaning step.

SF1 is a shape factor that shows the extent of unevenness on the surface of the toner particles, and is calculated as follows. An optical micrograph of a toner scattered on a glass slide is acquired to a Luzex image analyzer through a video cam, and SF1 is calculated according to the following expression from the value obtained by dividing square of the maximum length of the toner particles by the projected area $((ML)^2/A)$ for 50 toner particles, and the average value thereof is designated as SF1.

$$SF1 = \frac{(ML)^2}{A} \times \frac{\pi}{4} \times 100$$

wherein ML represents the maximum length of the toner particles, and A represents the projected area of the particles.

Production Method of Toner

In the exemplary embodiment, examples of the production method of the toner include a mechanical production method, such as a pulverizing method, and a so-called chemical production method, in which a resin particle dispersion liquid is produced by using the binder resin, and the toner is produced from the resin particle dispersion liquid.

In the exemplary embodiment, the production method of the toner may be a known method, such as a kneading and pulverizing method, an aggregation and integration method and a suspension polymerization method, and is not particularly limited, and an aggregation and integration method is preferably employed.

In the exemplary embodiment, the production method of the toner is preferably an aggregation and integration method, which may contain aggregating binder resin particles in a dispersion liquid containing the resin particles to provide aggregated particles (which may be hereinafter referred to as an aggregating step) and integrating the aggregated particles by heating (which may be hereinafter referred to as an integrating step).

Accordingly, the production method of the toner in the exemplary embodiment may contain: preparing a resin particle dispersion liquid; aggregating the resin particles, thereby forming aggregated particles; and integrating the aggregated particles by heating the resin particle to a temperature equal to or higher than a glass transition temperature and/or a melting point of the resin.

Aggregation and Integration Method

In the aggregating step, the binder resin may be used as a binder resin particle dispersion liquid.

Examples of the method of dispersing and forming the binder resin into particles in an aqueous medium include known methods, such as a forced emulsification method, a self emulsification method and an inversion emulsification method. Among these, a self emulsification method and an inversion emulsification method are preferably employed from the standpoint of the energy required for emulsification, the controllability of the particle diameter of the resulting emulsion, the safety and the like.

The self emulsification method and the inversion emulsification method are disclosed in "Choubiryushi Polymer no Ouyou Gijutsu" (Application Techniques of Superfine Polymer Particles) (published by CMC Publishing Co., Ltd.). Examples of the polar group that can be used for self emulsification include a carboxyl group and a sulfonic group.

A dispersion liquid of the binder resin obtained by emulsion polymerization according to a miniemulsion method may be used as the binder resin particle dispersion liquid, as described later.

Upon producing other binder resin dispersion liquid, an organic solvent may be used. In the case where an organic solvent is used, a part of the organic solvent may be removed for forming the resin particles.

For example, after emulsifying the binder resin-containing material, a part of the organic solvent may be removed, thereby solidifying as particles. Examples of the solidifying method include a method of dispersing the polycondensation resin-containing material into an aqueous medium to form an emulsion, drying the organic solvent at a gas-liquid interface while feeding air or an inert gas, such as nitrogen, with stirring the solution (exhaust drying method), a method of drying while bubbling an inert gas depending on necessity under reduced pressure (reduced pressure topping method), and a method of discharging an emulsion dispersion liquid of the polycondensation resin-containing material emulsified in an aqueous solution or an emulsion liquid of the polycondensation resin-containing material from fine pores into a shower form, which is received with a tray, and repeating the operation for drying (shower desolventizing method). The solvent may be removed by selecting or combining appropriately these methods in view of the evaporation rate and the solubility in water of the organic solvent used.

The resin particle dispersion liquid may have a median diameter of from approximately 0.05 to approximately 2.0 μm, preferably from approximately 0.1 to approximately 1.5 μm, and more preferably from approximately 0.1 to approximately 1.0 μm. When the median diameter is in the range, the dispersion state of the resin particles in the aqueous medium may be stabilized. Furthermore, upon using the resin particle dispersion liquid for producing the toner, the particle diameter may be easily controlled, and excellent releasing property and offset property may be obtained upon fixing.

The median diameter of the resin particles may be measured with a laser diffraction particle size distribution measuring apparatus (LA-920, available from Horiba, Ltd.)

The aggregating method in the aggregating step is not particularly limited, and examples thereof include an aggregating method that is generally used in an emulsion polymerization and aggregation method for a toner, such as a method of destabilizing the emulsion by increasing the temperature, changing the pH, adding a salt or the like, and stirring with a disperser or the like.

In the aggregating step, for example, the particles contained in the resin particle dispersion liquid, the colorant dispersion liquid and, depending on necessity, a releasing agent dispersion liquid are aggregated to form aggregated particles having the diameter of the toner particles. The aggregated particles are formed by hetero-aggregation or the like, and an ionic surfactant that is different in polarity from the aggregated particles and a compound having a monovalent charge, such as a metal salt, are added for the purposes of stabilizing the aggregated particles and controlling the particle size and the particle size distribution.

In the aggregating step, for example, the following procedures may be employed. The monomer in oil droplets emulsified in an aqueous phase is polymerized in the presence of a polymerization initiator to form resin polymer particles, and the polymer particles thus formed are aggregated according to a known aggregating method for aggregating (associating) particles containing at least colorant particles (in the case where the colorant is added to the resin in advance in the polymerizing step, the particles themselves are colored particles), thereby controlling the particle diameter and the particle size distribution of the toner. The toner particles may be produced by an emulsion polymerization and aggregation method. Specifically, the resulting resin particle dispersion liquid is mixed with a colorant particle dispersion liquid, a releasing agent particle dispersion liquid and the like, to which an aggregating agent is added, and the particles are subjected to hetero-aggregation to form aggregated particles having the particle diameter of the toner. Thereafter, the aggregated particles are melted and integrated by heating to a temperature that is equal to or higher than the glass transition temperature of the melting point of the resin particles, followed by rinsing and drying, thereby forming the toner particles. In this production method, the shape of the toner can be controlled from an irregular shape to a spherical shape by selecting the heating temperature condition.

In the aggregating step, two or more kinds of the resin particle dispersion liquids may be mixed and subjected to the aggregating step and the subsequent steps. In this case, such a procedure may be employed that the resin particle dispersion liquid is aggregated in advance to form first aggregated particles, and after adding another resin particle dispersion liquid thereto, the first aggregated particles may be formed into a multi-layer structure, for example, formation of a second shell layer on the surface of the first aggregated particles. The multi-layer particles may also be produced by the reverse order of the aforementioned example.

The surface of the particles may be crosslinked, for example, by subjecting the particles to a heat treatment, for the purpose of preventing the colorant from oozing from the surface of the particles after the aggregation. The surfactant used may be removed by rising with water, an acid, an alkali or the like, depending on necessity.

In the integrating step, the binder resin in the aggregated particles is melted under a temperature condition equal to or higher than the melting point or the glass transition temperature of the binder resin, and the shape of the aggregated particles is changed from an irregular shape to a spherical shape.

For maintaining the phase separation structure of the core/shell particles of the toner, the aggregated particles may be melted at a temperature that is higher than the glass transition temperature of the resin used in the shell by 50° C. or less. When the aggregated particles is melted at a temperature that is higher than the glass transition temperature of the resin used in the shell by 50° C. or less, the core component may not have a decreased viscosity to prevent integration of the resin for the core, thereby maintaining the microscopic structure and providing a sufficient pressure plasticization behavior.

Thereafter, the aggregated material is separated from the aqueous medium and then is rinsed and dried depending on necessity, thereby providing the toner particles.

After completing the aggregating step and the integrating step, the toner may be obtained by subjecting optionally a rinsing step, a solid-liquid separating step and a drying step. The rinsing step may be performed by substitution rinsing with ion exchanged water from the standpoint of charging property. The solid-liquid separating step is not particularly limited, and aspiration filtration, pressure filtration or the like may be employed from the standpoint of productivity. The drying step is also not particularly limited, and freeze drying, flash-jet drying, fluidized drying, vibration fluidized drying or the like may be employed from the standpoint of productivity.

Application to Chemical Toner Production Method Other than Aggregation Method

Polyaddition Reaction Method

In the exemplary embodiment, examples of the production method other than the emulsion aggregation method of the toner for developing an electrostatic image include a production method containing a step of dispersing, in an aqueous medium, a solution and/or a dispersion liquid obtained by dissolving and/or dispersing, in an organic solvent, a polyester resin containing at least the crystalline polyester resin, a compound containing a group having active hydrogen, a polymer having a site reactive to the compound containing a group having active hydrogen, the releasing agent and the colorant (which may be hereinafter referred to as a dispersing step), a step of producing the binder resin through reaction of the compound containing a group having active hydrogen and the polymer (which may be hereinafter referred to as a binder resin producing step), and simultaneously with and/or after the binder resin producing step, a step of removing the organic solvent (which may be hereinafter referred to as a solvent removing step). The production method may be hereinafter referred to as a polyaddition reaction method. The application of the polyaddition reaction method to the production method of the toner of the exemplary embodiment increases the hardness of the surface of the toner, thereby suppressing efficiently aggregation coarse particles from being generated.

The dispersing step in the polyaddition reaction method is such a step that a solution and/or a dispersion liquid obtained by dissolving and/or dispersing, in an organic solvent, a polyester resin containing at least the crystalline polyester resin, a compound containing a group having active hydrogen, a polymer having a site reactive to the compound containing a group having active hydrogen, the releasing agent and the colorant are dispersed in an aqueous medium. The polyester resin may be the resin particle dispersion liquid used in the emulsion polymerization aggregation method. In the case where a polyester resin in lump form is used, a step of pulverizing the polyester resin in lump form may be further employed. Upon pulverization, the polyester resin in lump form may be coarsely pulverized with a hammer mill, Roatplex or the like, and then finely pulverized to an average particle diameter of from approximately 3 to approximately 15 μm with a fine pulverizer using jet stream, a mechanical fine pulverizer or the like. The pulverized product may be then controlled in particle size to from approximately 5 to approximately 20 μm with a pneumatic classification device. In alternative, the polyester resin in lump form and the additives including the colorant are mixed in a pressure kneader to prepare a resin composition containing the additives and the polyester resin, which may be then pulverized with a hammer mill or the like.

The releasing agent particle dispersion liquid and the colorant particle dispersion liquid described above may be used in this step.

The resulting resin particle dispersion or pulverized product of the polyester resin may be dispersed along with the releasing agent and the colorant in an organic solvent under heating to prepare a dissolved product in a semi-dissolved state. Subsequently, an isocyanate group-containing polyester prepolymer may be mixed and dissolved therein, and then an amine compound, such as a ketimine compound, may be further mixed therein, thereby preparing the solution and/or dispersion liquid having the components dissolved and/or dispersed in an organic solvent.

Examples of the method for preparing the solution and/or dispersion have been described, but the method for preparing the solution and/or dispersion is not particularly limited and may be appropriately designed depending on the polyester resin, the releasing agent, the colorant and the like used.

Examples of the organic solvent used in the exemplary embodiment include toluene, ethyl acetate, butyl acetate, methyl ethyl ketone and tetrahydrofuran.

In the dispersing step in the polyaddition reaction method, ion exchanged water or the like is added to the resulting solution and/or dispersion, thereby emulsifying the solution and/or dispersion.

The dispersing step of dispersing the solution and/or dispersion in an aqueous medium may be such a step that emulsification (formation of liquid droplets) is forcibly performed by applying mechanical energy in the aqueous phase. The device for applying mechanical energy is not particularly limited, and may be a known dispersing device, and examples thereof include a homomixer, an ultrasonic dispersing device, a Manton-Gorlin homogenizer and a pressure homogenizer.

The binder resin producing step and the solvent removing step in the polyaddition reaction method will be described. In the binder resin producing step in the exemplary embodiment, the compound containing a group having active hydrogen and the polymer are reacted with each other to provide the binder resin. A modified resin may be produced through reaction of the compound containing a group having active hydrogen and the polymer, whereby a binder resin containing the modified resin in addition to the crystalline polyester resin may be produced.

The polyaddition reaction may be performed at a temperature of from approximately 50 to approximately 100° C., and preferably from approximately 60 to approximately 90° C. The period of time for performing the polyaddition reaction may be from approximately 0.1 to approximately 10 hours, and preferably from approximately 2 to approximately 5 hours, while depending on the materials used for the reaction and the reaction temperature.

The solvent removing step is such a step that the organic solvent is removed simultaneously with and/or after the binder resin producing step. In the exemplary embodiment, the solvent removing step may be performed simultaneously with the binder resin producing step.

After the solvent removing step, rinsing and drying steps may be performed for removing impurities or the like.

Developer for Electrostatic Image

The toner (toner for developing an electrostatic image) described above may be used as a developer for an electrostatic image (which may be referred in the exemplary embodiment simply to a developer). The developer is not particularly limited as far as it contains the toner, and the composition of components thereof may be appropriately determined depending on purposes. A one-component developer is produced by using the toner solely, and a two-component developer is produced by using the toner combined with a carrier. In the exemplary embodiment, a two-component developer containing the toner and a carrier may be prepared.

The carrier used in the exemplary embodiment is not particularly limited, and examples thereof include magnetic material particles, such as iron powder, ferrite powder, iron oxide powder and nickel powder; a resin-coated carrier having magnetic material particles as a core material having formed thereon a resin coated layer formed by coating with a resin, such as a styrene resin, a vinyl resin, an ethylene resin, a rosin resin, a polyester resin and a melamine resin, or wax, such as stearic acid; and a magnetic material dispersion carrier having magnetic material particles dispersed in a binder resin. Among these, the resin-coated carrier is preferred since the charging property of the toner and the resistance of the carrier can be controlled with the constitution of the resin-coated layer.

The mixing ratio of the toner and the carrier in the two-component developer for an electrostatic image is generally from approximately 2 to approximately 10 parts by weight of the toner per 100 parts by weight of the carrier. The preparation method of the developer is not particularly limited, and examples thereof include a method of mixing with a V-blender or the like.

Image Forming Method and Image Forming Apparatus

An image forming method according to the exemplary embodiment contains: charging an image holding member; forming an electrostatic latent image on a surface of the image holding member; developing the electrostatic latent image formed on the surface of the image holding member, with a toner for developing an electrostatic image or a developer for an electrostatic image, thereby forming a toner image; transferring the toner image formed on the surface of the image holding member, to a surface of a transfer material; and fixing the toner image, the developer for an electrostatic image being the developer for an electrostatic image according to the exemplary embodiment. In the fixing step, the transferred toner image may be fixed under pressure without heating.

An image forming apparatus according to the exemplary embodiment contains: an image holding member; a charging unit that charges the image holding member; an exposing unit that exposes the charged image holding member, thereby forming an electrostatic latent image on the image holding member; a developing unit that develops the electrostatic latent image with a developer, thereby forming a toner image; a transferring unit that transfers the toner image from the image holding member to a transfer material; and a fixing unit that fixes the toner image, the developer being the developer for an electrostatic image according to the exemplary embodiment. The fixing unit may contain a pressurizing device and may not contain a heating device.

The aforementioned steps and units may be ones that are employed in known ordinary image forming method and image forming apparatus. In the exemplary embodiment, the transfer material is a final recording medium, and in the case where an intermediate transfer material or the like is used, the toner image formed on the surface of the electrostatic image holding member may be once transferred an intermediate transfer material and then finally transferred to the transfer material, and the toner image thus transferred to the surface of the transfer material is fixed to the surface of the transfer material.

The image forming method may further contain other steps, for example, cleaning the surface of the image holding member, and the image forming apparatus may further contain other units, for example, a cleaning unit that cleans the surface of the image holding member.

In the case where an electrophotographic photoconductor is used as the image holding member, for example, the following procedures may be carried out. The surface of the electrophotographic photoconductor is uniformly charged with a corotron charging device, a contact charging device or the like, and then exposed to form an electrostatic image. Subsequently, the electrophotographic photoconductor is made in contact with or is made close to a developing roll having a developer layer on the surface thereof, thereby attaching toner particles to the electrostatic image to form a toner image on the electrophotographic photoconductor. The toner image thus formed is transferred to the surface of the transfer member, such as paper, with a corotron charging device or the like. The toner image thus transferred to the surface of the recording medium is fixed with a fixing device, thereby forming an image on the recording medium.

Examples of the electrophotographic photoconductor include an inorganic photoconductor, such as amorphous silicon and selenium, and an organic photoconductor containing polysilane, phthalocyanine and the like as a charge generating material and a charge transporting material, and an amorphous silicon photoconductor is preferably employed owing to the long service life thereof.

Fixing Step and Fixing Unit

In the exemplary embodiment, the fixing step may be performed by pressurizing without heating. The fixing unit may not have a heating device.

The fixing pressure may be from approximately 0.1 to approximately 5 MPa, preferably from approximately 0.15 to approximately 3 MPa, and more preferably from approximately 0.2 to approximately 2 MPa.

When the fixing pressure (pressure upon fixing) is approximately 0.1 MPa or more, sufficient fixing property may be obtained. When the fixing pressure is approximately 5 MPa or less, such problems as curling of paper after fixing may be prevented from occurring.

The fixing pressure herein means the maximum fixing pressure shown later.

The fixing roller may be selected from a known fixing roller that can apply a fixing pressure in the aforementioned range.

Examples of the fixing roller include a fixing roller containing a cylindrical metallic core having coated thereon a fluorine resin (such as Teflon, a trade name), a silicone resin and a perfluoroalkylate resin (PFA), and a fixing roller formed of stainless steel (SUS) may be employed for providing a high fixing pressure. The fixing step may be generally performed by passing the transfer material between two rollers, and the two rollers may be produced with the same material or with a combination of different materials respectively. Examples of the combination include SUS and SUS, SUS and a silicone resin, SUS and PFA, and PFA and PFA.

The pressure distribution between the fixing roller and a pressure roller or the like may be measured with a commercially available pressure distribution measuring sensor, and specifically may be measured with a measuring system for pressure between rollers, available from Kamata Industry Co., Ltd. In the exemplary embodiment, the maximum pressure upon pressure fixing means the maximum value of the pressure varying from the inlet of the fixing nip to the outlet thereof in the conveying direction of the paper.

In the exemplary embodiment, the fixing step is performed without heating. The meaning of fixing without heating herein means that the fixing unit does not have a direct heating device thereto. Accordingly, it is not avoided that the temperature inside the apparatus is increased beyond the environmental temperature owing to heat generated from the other motive power units.

The fixing temperature may be from approximately 15 to approximately 50° C., preferably from approximately 15 to approximately 45° C., and more preferably from approximately 15 to approximately 40° C.

When the fixing temperature is in the range, good fixing property may be obtained.

Toner Cartridge and Process Cartridge

A toner cartridge according to the exemplary embodiment contains at least the toner for developing an electrostatic image of the exemplary embodiment.

The toner cartridge of the exemplary embodiment may contain the toner for developing an electrostatic image of the exemplary embodiment as a developer for an electrostatic image.

A process cartridge according to the exemplary embodiment contains at least one of the toner for developing the electrostatic image of the exemplary embodiment, and the developer for electrostatic image of the exemplary embodiment, and contains at least one selected from the group consisting of a developing unit that develops an electrostatic latent image formed on a surface of an image holding member with the toner for developing an electrostatic image or the developer for an electrostatic image, thereby forming a toner image, a charging unit that charges the image holding member and a surface of the image holding member, and a cleaning unit that removes the toner remaining on the surface of the image holding member.

The toner cartridge of the exemplary embodiment may be capable of being detached to an image forming apparatus. Accordingly, the toner cartridge of the exemplary embodiment containing the toner of the exemplary embodiment may be used in an image forming apparatus that has a structure capable of detaching a toner cartridge.

The toner cartridge may be such a toner cartridge that contains a toner and a carrier, and may contain separate cartridges, one of which contains a toner solely, and the other contains a carrier solely.

The process cartridge of the exemplary embodiment may be capable of being detached to an image forming apparatus.

The process cartridge of the exemplary embodiment may further contain other units, such as a destaticizing unit.

The toner cartridge and the process cartridge each may have a known structure, which is disclosed, for example, in JP-A-2008-209489 and JP-A-2008-233736.

EXAMPLE

The exemplary embodiment will be described in detail with reference to examples and comparative examples below, but the exemplary embodiment is not limited to the examples.

In the examples and comparative examples, the unit "part" means "part by weight" unless otherwise indicated.

Measurements

Measurement of Molecular Weight

In the measurement of molecular weights, a weight average molecular weight Mw and/or a number average molecular weight Mn are measured by gel permeation chromatography (GPC) under the following conditions. A solvent (tetrahydrofuran) is made to flow at a temperature of 40° C. at a flow rate of 1.2 mL per minute, and a tetrahydrofuran solution of a specimen having a concentration of 0.2 g per 20 mL in an amount of 3 mg in terms of weight of specimen is injected to measure the molecular weight. Upon measuring the molecular weight of the specimen, such conditions are employed that is encompassed in the range where the logarithm of the molecular weight of the calibration curve prepared with several kinds of monodisperse polystyrene standard samples and the count number exhibit linear relationship. The reliability of the measurement results is confirmed by the fact that the molecular weights of NBS 706 polystyrene standard sample measured under the conditions are as follows.

Weight average molecular weight $Mw=28.2\times10^4$

Number average molecular weight $Mn=13.7\times10^4$

The GPC columns used are TSK-GEL, GMH and the like, available from Tosoh Corporation, satisfying the conditions.

Measurement of Median Diameter

The measurement method of the median diameter varies depending on the particle diameter of the particles to be measured, and is measured with a laser diffraction particle size distribution measuring apparatus (LA-920, available from Horiba, Ltd.) for a particle diameter of less than 1 μm, and with Coulter Multisizer II (available from Beckman Coulter, Inc.) for a particle diameter of 1 μm or more.

Measurement of Glass Transition Temperature and Melting Point

The glass transition temperature and the melting point of the resin are measured with a differential scanning calorimeter DSC-50, available from Shimadzu Corporation.

Preparation of Core/Shell Particle Dispersion Liquid

Preparation of Resin Particle Dispersion Liquid (A1)

300 parts by weight of ion exchanged water and 1.5 parts by weight of TTAB (tetradecyltrimethylammonium bromide, available from Sigma-Aldrich, Inc.) are placed in a round-bottom glass flask and bubbled with nitrogen for 20 minutes, and then the mixture is increased in temperature to 65° C. under stirring. 40 parts by weight of n-butyl acrylate monomer is added thereto, and the mixture is stirred for further minutes. 0.5 part by weight of an initiator V-50 (2,2'-azobis (2-methylpropiondiamine)dihydrochloride, available from Wako Pure Chemical Industries, Ltd.) is dissolved in 10 parts by weight of ion exchanged water in advance, and then placed in the flask. The mixture in the flask is maintained at 65° C. for 3 hours, and an emulsion liquid, which is obtained by emulsifying 50 parts by weight of styrene monomer, 20 parts by weight of n-butyl acrylate monomer, 2.5 parts by weight of acrylic acid and 0.8 part by weight of dodecanethiol in 100 parts by weight of ion exchange water having 0.5 part by weight of TTAB dissolved therein, is continuously charged into the flask over 2 hours with a metering pump. The temperature is increased to 70° C. and maintained for 2 hours to complete polymerization. A core/shell resin particle dispersion liquid (A1) having a weight average molecular weight Mw of 22,000, an average particle diameter of 170 nm and a solid content of 25% by weight is obtained.

The particles contained in the dispersion liquid are confirmed as core/shell resin particles in such a manner that the particles are embedded in an epoxy resin, a cross sectional segment of the resin particle is produced with a diamond knife, then dyed in ruthenium vapor, and observed with a transmission electron microscope.

After drying the resin particles in air at 40° C., the resin of the particles is measured for glass transition temperature behavior from −150° C. with a differential scanning calorimeter (DSC), available from Shimadzu Corporation. Glass transition attributed to polybutyl acrylate is observed around −48° C., and glass transition attributed to a copolymer containing a styrene-butyl acrylate-acrylic acid copolymer is observed around 56° C., providing a difference between glass transition temperatures of 104° C.

Preparation of Block Polyester Resin Particle Dispersion Liquid

Preparation of Block Polyester Resin Particle Dispersion Liquid (B1)

| | |
|---|---|
| 1,4-Cyclohexanedicarboxylic acid | 175 parts by weight |
| Bisphenol A 1-mol ethylene oxide adduct (2-mol adduct on both ends) | 310 parts by weight |
| Dodecylbenzene sulfonic acid | 0.5 part by weight |

The aforementioned materials are mixed and placed in a reactor equipped with a stirrer, and are subjected to polycondensation in a nitrogen atmosphere at 100° C. for 4 hours. A homogeneous and transparent non-crystalline resinous compound having high Tg (50° C.) is obtained.

The weight average molecular weight thereof measured with GPC is 5,000.

| | |
|---|---|
| Caprolactone | 90 parts by weight |
| Dodecylbenzenesulfonic acid | 0.2 part by weight |

The aforementioned materials are mixed and placed in a reactor equipped with a stirrer, and are subjected to polycondensation in a nitrogen atmosphere at 90° C. for 5 hours. A homogeneous and transparent crystalline polyester oligomer having low Tg (−50° C.) is obtained.

The weight average molecular weight thereof measured with GPC is 6,000, and the crystal melting point is 60° C.

The aforementioned two resins are mixed at 100° C. and heated in a reactor equipped with a stirrer for 2 hours, thereby forming a block copolymer. The block copolymer has a glass transition temperature (on-set) measured by DSC of 54° C., and the melting point thereof is observed small around 65° C.

The weight average molecular weight thereof measured with GPC is 11,500.

0.5 part by weight of soft type sodium dodecylbenzenesulfonate as a surfactant is added to 100 parts by weight of the resin, to which 300 parts by weight of ion exchanged water is further added, and the mixture is sufficiently mixed and dispersed under heating to 80° C. with a homogenizer (Ultra-Turrax T50, available from IKA Works Japan Co., Ltd.) in a round-bottom glass flask.

Thereafter, the pH in the system is adjusted to 5.0 with a 0.5 mol/L sodium hydroxide aqueous solution, and then the mixture is heated to 90° C. under continuously stirring with a homogenizer, thereby providing an emulsion dispersion liquid of the block copolymer resin. Thus, the block polyester resin particle dispersion liquid (B1) having a median diameter of the resin particles of 180 nm and a solid content of 20% is obtained.

Preparation of Block Polyester Resin Particle Dispersion Liquid (B2)

| | |
|---|---|
| 1,4-Cyclohexanedicarboxylic acid | 175 parts by weight |
| Bisphenol A 1-mol ethylene oxide adduct (2-mol aciduct on both ends) | 310 parts by weight |
| Dodecylbenzene sulfonic acid | 0.5 part by weight |

The aforementioned materials are mixed and placed in a reactor equipped with a stirrer, and are subjected to polycondensation in a nitrogen atmosphere at 100° C. for 5 hours. A homogeneous and transparent non-crystalline resinous compound having high Tg (50° C.) is obtained.

The weight average molecular weight thereof measured with GPC is 7,500.

| | |
|---|---|
| Dodecylbenzenesulfonic acid | 0.36 part by weight |
| 1,9-Nonanediol | 80 parts by weight |
| 1,10-Decamethylenedicarboxylic acid | 115 parts by weight |

The aforementioned materials are mixed and melted at 80° C., and the mixture is maintained at 80° C. for 5 hours, thereby providing a crystalline resin having a weight average molecular weight by GPC of 8,000 and a crystal melting point of 64° C. (Tg: −80° C.)

The aforementioned two resins are mixed at 100° C. and heated in a reactor equipped with a stirrer for 30 minutes, thereby forming a block copolymer. The block copolymer (B2) has a glass transition temperature (on-set) measured by DSC of 55° C., and the melting point thereof is observed small around 65° C.

The weight average molecular weight thereof measured with GPC is 16,000.

0.5 part by weight of soft type sodium dodecylbenzenesulfonate as a surfactant is added to 100 parts by weight of the resin, to which 300 parts by weight of ion exchanged water is further added, and the mixture is sufficiently mixed and dispersed under heating to 80° C. with a homogenizer (Ultra-Turrax T50, available from IKA Works Japan Co., Ltd.) in a round-bottom glass flask.

Thereafter, the pH in the system is adjusted to 5.0 with a 0.5 mol/L sodium hydroxide aqueous solution, and then the mixture is heated to 90° C. under continuously stirring with a homogenizer, thereby providing a resin particle emulsion dispersion liquid of the block copolymer resin. Thus, the block polyester resin particle dispersion liquid (B2) having a median diameter of the resin particles of 170 nm and a solid content of 20% is obtained.

Preparation of Catalyst in Composite Form with Inorganic Particles (Enzyme in Composite Form with Inorganic Particles) (D1)

| | |
|---|---|
| Lipoxidase (available from Tokyo Kasei Kogyo Co., Ltd.) | 10 parts by weight |
| Water/ethanol mixed solvent (2/8) The aforementioned materials are dissolved to provide an enzyme solution. | 40 parts by weight |
| Hydrophobic silica (R972, available from Nippon Aerosil Co., Ltd., average particle diameter of primary particles: ca. 16 nm) | 40 parts by weight |

The aforementioned silica is mixed with the enzyme solution, and after sufficiently stirring, the mixture is placed in an evaporator, from which the solvent is removed under reduced pressure with a vacuum pump under stirring by rotation. The resulting residue is taken out and pulverized with a sample mill, thereby providing silica surface-treated with the enzyme (20% by weight).

Preparation of Catalyst in Composite Form with Inorganic Particles (Iron Naphthenate in Composite Form with Inorganic Particles) (D2)

| | |
|---|---|
| Iron naphthenate mineral spirit solution (6%) | 166 parts by weight |
| Ethanol | 100 parts by weight |

The aforementioned materials are dissolved, thereby providing an iron naphthenate solution.

| | |
|---|---|
| Hydrophobic titanium oxide particles (STT-30EHJ, available from Titan Kogyo, Ltd., particle diameter with electron microscope: 30 to 50 nm) | 40 parts by weight |

The aforementioned titanium oxide particles are mixed with the iron naphthenate solution, and after sufficiently stirring, the mixture is placed in an evaporator, from which the solvent is removed under reduced pressure with a vacuum pump under stirring by rotation. The resulting residue is taken out and pulverized with a sample mill, thereby providing titanic surface-treated with iron naphthenate (20% by weight).

Preparation of Colorant Particle Dispersion Liquid (1)

Cyan pigment (C.I. Pigment Blue 15:3) 50 parts by weight (copper phthalocyanine available from Dainichiseika Colour & Chemicals Mfg. Co., Ltd.)

| | |
|---|---|
| Anionic surfactant (soft type dodecylbenzenesulfonic acid) | 5 parts by weight |
| Ion exchanged water | 200 parts by weight |

The aforementioned materials are mixed and dissolved, and dispersed with a homogenizer (Ultra-Turrax, available from IKA Works Japan Co., Ltd.) for 5 minutes and an ultrasonic bath for 10 minutes, thereby providing a cyan colorant particle dispersion liquid (1) having a median diameter of 190 nm and a solid content of 21.5%.

Preparation of Oxidation Polymerizable Monomer Particle Dispersion Liquid or Dispersion Liquid of Particles of Polymer Having Ethylenic Unsaturated Group An oxidation polymerizable monomer particle dispersion liquid and a dispersion liquid of particles of a polymer having an ethylenically unsaturated group may be hereinafter referred to as a reactive particle dispersion liquid.

Preparation of Reactive Particle Dispersion Liquid (C1)

| | |
|---|---|
| Linseed oil | 50 parts by weight |
| Anionic surfactant (soft type dodecylbenzenesulfonic acid) | 3 parts by weight |
| Ion exchanged water | 200 parts by weight |

The aforementioned materials are mixed and dissolved, and dispersed with a homogenizer (Ultra-Turrax, available from IKA Works Japan Co., Ltd.) for 2 minutes, thereby providing a reactive particle dispersion liquid (C1) having a median diameter of 200 nm and a solid content of 20%.

Preparation of Reactive Particle Dispersion Liquid (C2)

Synthesis of Unsaturated Polyester Resin

85% by mol of bisphenol A propylene oxide adduct and 15% by mol of trimethylolpropane as an alcohol component, 100% by mol of fumaric acid as an unsaturated acid component, and a slight amount of tin were subjected to polycondensation at 200° C. for 4 hours, thereby providing an unsaturated polyester resin having a weight molecular weight of 5,000 and Tg of 55° C.

| | |
|---|---|
| Unsaturated polyester resin | 50 parts by weight |
| Anionic surfactant (soft type dodecylbenzenesulfonic acid) | 3 parts by weight |
| Ion exchanged water | 200 parts by weight |

The aforementioned materials are mixed and dissolved under heating to 90° C., and dispersed with a homogenizer (Ultra-Turrax, available from IKA Works Japan Co., Ltd.) for 10 minutes and an ultrasonic bath for 20 minutes, thereby providing a reactive particle dispersion liquid (C2) having a median diameter of 270 nm and a solid content of 20%.

Toner Example 1

| | |
|---|---|
| Block polyester resin (used in production of B2) | 85 parts by weight |
| Carbon black (R330, available from Cabot Speciality Chemicals, Inc.) | 5 parts by weight |
| Paraffin wax (FNP9, available from Nippon Seiro Co., Ltd.) | 5 parts by weight |
| Linseed oil | 5 parts by weight |

The aforementioned materials are mixed and kneaded with a Banbury mixer available from Kobe Steel Ltd., and then the mixture is pulverized and classified, thereby providing a toner having an irregular shape having a diameter of 6.0 μm and a volume average particle size distribution index GSDv of 1.30.

1 part by weight of iron naphthenate in the composite form with inorganic particles (D2) and 1 part by weight of hydrophobic silica (TS720, available from Cabot Speciality Chemicals, Inc., average particle diameter: 12 nm) are added to 50 parts by weight of the toner particles, and mixed with a sample mill, thereby providing an externally added toner.

A ferrite carrier having polymethyl methacrylate (available from Soken Chemical & Engineering Co., Ltd.) coated in an amount of 1% and having an average particle diameter of 50 μm is used, and the externally added toner is weighed to make a toner concentration of 5%. The carrier and the toner are mixed and agitated in a ball mill for 5 minutes, thereby providing a developer.

Evaluation of Toner

The developer thus obtained is used in a modified machine of DocuCentre Color f450, available from Fuji Xerox Co., Ltd., in which the two-roller type fixing device is modified to have a maximum fixing pressure of 0.4 MPa. The fixing device is modified to a two-roller type fixing device capable of controlling the maximum fixing pressure, and the pressure roller on the side of image is changed to a high-hardness roller containing a stainless steel pipe having coated thereon Teflon, a trade name. S-Grade paper designated by Fuji Xerox Co., Ltd. is used as transfer paper, and the fixing property is investigated at a process speed controlled to 180 mm/sec. As a result, good pressure fixing property is obtained, and the image exhibits sufficient fixing uniformity in a cloth rubbing test (temperature inside apparatus: 30° C.).

An image is formed by using an OHP sheet V50 for monochrome print designated by Fuji Xerox Co., Ltd. under the aforementioned conditions, and is evaluated for durability of the image by a cloth rubbing test, in which the number of reciprocal rubbing, which is generally 5, is changed to 100. As a result, improvement is observed while the image is slightly worn, as compared to the case using no oxidation polymerization compound, in which an image becomes difficult to be read (B).

100 sheets of OHP sheet V50 for monochrome print each having an image formed are stacked and placed in a chamber at 70° C. for 3 hours. As a result, improved heat storage stability is observed while the sheets are slightly adhered (B).

The resulting toner is measured for a temperature T(10 MPa) where the toner has a viscosity of $10^4$ Pa·s at a pressure of 10 MPa applied with a flow tester and a temperature T(1 MPa) where the toner has a viscosity of $10^4$ Pa·s at a pressure of 1 MPa applied with a flow tester. As a result, T(1 MPa), T(10 MPa) and (T(1 MPa)−T(10 MPa)) are 70° C., 40° C. and 30° C., respectively.

Toner Example 2

Preparation of Toner Particles

| | |
|---|---|
| Resin particle dispersion liquid (A1) | 168 parts by weight (42 parts by weight of resin) |
| Colorant particle dispersion liquid (1) | 40 parts by weight (8.6 parts by weight of pigment) |
| Reactive particle dispersion liquid (C1) | 40 parts by weight |
| Polyaluminum chloride | 0.15 part by weight |
| Ion exchanged water | 300 parts by weight |

The aforementioned materials are sufficiently mixed and dispersed with a homogenizer (Ultra-Turrax T50, available from IKA Works Japan Co., Ltd.) in a round-bottom stainless steel flask, and heated on a heating oil bath to 42° C. while stirring the content of the flask. After maintaining at 42° C. for 60 minutes, 105 parts by weight of the resin particle dispersion liquid (A1) (21 parts by weight of resin) is added thereto, followed by stirring gradually.

Thereafter, the pH in the system is adjusted to 6.0 with a 0.5 mol/L sodium hydroxide aqueous solution, and then the mixture is heated to 95° C. under continuous stirring. During the temperature increase to 95° C., the pH in the system is usually decreased to 5.0 or less, but in this case, the sodium hydroxide aqueous solution is further added dropwise to prevent the pH from being decreased to 5.5 or less.

After completing the reaction, the mixture is cooled and filtered, sufficiently rinsed with ion exchanged water, and then subjected to solid-liquid separation by Nutsche suction filtration. The solid matter is again dispersed in 3 L of ion exchanged water at 40° C., and stirred and rinsed at 300 rpm for 15 minutes. The rinsing operation is repeated 5 times, and the mixture is subjected to solid-liquid separation by Nutsche suction filtration. The solid matter is dried in vacuum for 12 hours, thereby providing toner particles.

The toner particles are measured for particle diameter with a Coulter Counter. As a result, the accumulated volume average particle diameter D50 is 5.2 μm, and the volume average particle size distribution index GSDv is 1.22. The shape factor SF1 of the toner particles obtained by shape observation with a Luzex image analyzer is 130, which indicates a potato-like shape.

3 parts by weight of the enzyme in a composite form with inorganic particles (D1) and 1 part by weight of hydrophobic silica (TS720, available from Cabot Speciality Chemicals, Inc., average particle diameter: 12 nm) are added to 50 parts by weight of the toner particles, and mixed with a sample mill, thereby providing an externally added toner.

A ferrite carrier having polymethyl methacrylate (available from Soken Chemical & Engineering Co., Ltd.) coated in an amount of 1% and having an average particle diameter of 50 μm is used, and the externally added toner is weighed to make a toner concentration of 5%. The carrier and the toner are mixed and agitated in a ball mill for 5 minutes, thereby providing a developer.

Evaluation of Toner

The developer thus obtained is used in a modified machine of DocuCentre Color f450, available from Fuji Xerox Co., Ltd., in which the two-roller type fixing device is modified to have a maximum fixing pressure of 0.4 MPa. S-Grade paper designated by Fuji Xerox Co., Ltd. is used as transfer paper, and the fixing property is investigated at a process speed controlled to 180 mm/sec. As a result, good pressure fixing property is obtained, and the image exhibits sufficient fixing uniformity in a cloth rubbing test (temperature inside apparatus: 30° C.).

An image is formed by using an OHP sheet V50 for monochrome print designated by Fuji Xerox Co., Ltd. under the aforementioned conditions, and is evaluated for durability of the image by a cloth rubbing test, in which the number of reciprocal rubbing, which is generally 5, is changed to 100. As a result, substantially no wear is observed in the image (A).

100 sheets of OHP sheet V50 for monochrome print each having an image formed are stacked and placed in a chamber at 70° C. for 3 hours. As a result, good heat storage stability is observed without adhesion between the sheets (A).

The resulting toner is measured for a temperature T(10 MPa) where the toner has a viscosity of $10^4$ Pa·s at a pressure of 10 MPa applied with a flow tester and a temperature T(1 MPa) where the toner has a viscosity of $10^4$ Pa·s at a pressure of 1 MPa applied with a flow tester. As a result, T(1 MPa), T(10 MPa) and (T(1 MPa)−T(10 MPa)) are 60° C., 10° C. and 50° C., respectively.

Toner Example 3

Preparation of Toner Particles

| | |
|---|---|
| Resin particle dispersion liquid (B1) | 168 parts by weight (42 parts by weight of resin) |
| Colorant particle dispersion liquid (1) | 40 parts by weight (8.6 parts by weight of pigment) |
| Reactive particle dispersion liquid (C2) | 40 parts by weight |
| Polyaluminum chloride | 0.15 part by weight |
| Ion exchanged water | 300 parts by weight |

The aforementioned materials are sufficiently mixed and dispersed with a homogenizer (Ultra-Turrax T50, available from IKA Works Japan Co., Ltd.) in a round-bottom stainless steel flask, and heated on a heating oil bath to 42° C. while stirring the content of the flask. After maintaining at 42° C. for 60 minutes, 105 parts by weight of the reactive particle dispersion liquid (C2) (21 parts by weight of resin) is added thereto, followed by stirring gradually.

Thereafter, the pH in the system is adjusted to 6.0 with a 0.5 mol/L sodium hydroxide aqueous solution, and then the mixture is heated to 95° C. under continuous stirring. During the temperature increase to 95° C., the pH in the system is usually decreased to 5.0 or less, but in this case, the sodium hydroxide aqueous solution is further added dropwise to prevent the pH from being decreased to 5.5 or less.

After completing the reaction, the mixture is cooled and filtered, sufficiently rinsed with ion exchanged water, and then subjected to solid-liquid separation by Nutsche suction filtration. The solid matter is again dispersed in 3 L of ion exchanged water at 40° C., and stirred and rinsed at 300 rpm for 15 minutes. The rinsing operation is repeated 5 times, and the mixture is subjected to solid-liquid separation by Nutsche suction filtration. The solid matter is dried in vacuum for 12 hours, thereby providing toner particles.

The toner particles are measured for particle diameter with a Coulter Counter. As a result, the accumulated volume average particle diameter D50 is 5.0 μm, and the volume average particle size distribution index GSDv is 1.24. The shape factor SF1 of the toner particles obtained by shape observation with a Luzex image analyzer is 129, which indicates a potato-like shape.

3 parts by weight of the iron naphthenate in a composite form with inorganic particles (D2) and 1.5 parts by weight of hydrophobic silica (TS720, available from Cabot Speciality Chemicals, Inc., average particle diameter: 12 nm) are added to 50 parts by weight of the toner particles, and mixed with a sample mill, thereby providing an externally added toner.

A ferrite carrier having polymethyl methacrylate (available from Soken Chemical & Engineering Co., Ltd.) coated in an amount of 1% and having an average particle diameter of 50 μm is used, and the externally added toner is weighed to make a toner concentration of 5%. The carrier and the toner are mixed and agitated in a ball mill for 5 minutes, thereby providing a developer.

The evaluation of the toner is performed in the same manner as above.

The toner is investigated for fixing property. As a result, good pressure fixing property is obtained, and the image exhibits sufficient fixing uniformity in a cloth rubbing test (temperature inside apparatus: 30° C.)

An image is formed by using an OHP sheet V50 for monochrome print designated by Fuji Xerox Co., Ltd. under the aforementioned conditions, and is evaluated for durability of the image by a cloth rubbing test, in which the number of reciprocal rubbing, which is generally 5, is changed to 100. As a result, substantially no wear is observed in the image (A).

100 sheets of OHP sheet V50 for monochrome print each having an image formed are stacked and placed in a chamber at 70° C. for 3 hours. As a result, good heat storage stability is observed without adhesion between the sheets (A).

The resulting toner is measured for a temperature T(10 MPa) where the toner has a viscosity of $10^4$ Pa·s at a pressure of 10 MPa applied with a flow tester and a temperature T(1 MPa) where the toner has a viscosity of $10^4$ Pa·s at a pressure of 1 MPa applied with a flow tester. As a result, T(1 MPa), T(10 MPa) and (T(1 MPa)−T(10 MPa)) are 50° C., 10° C. and 40° C., respectively.

Toner Example 4

A toner is produced in the same manner as in Toner Example 3 except that 1 part by weight of the enzyme in a composite form with inorganic particles (D1) is added in addition to 3 parts by weight of the iron naphthenate in a composite form with inorganic particles (D2). The toner thus obtained is evaluated in the same manner as above. As a result, the toner exhibits particularly good durability (AA).

Toner Example 5

Preparation of Isocyanate Group-Containing Polyester Prepolymer

| | |
|---|---|
| Bisphenol A 2-mol ethylene oxide adduct (4-mol adduct on both ends) | 724 parts by weight |
| 1,4-cyclohexane dicarboxylic acid | 100 parts by weight |
| Fumaric acid | 200 parts by weight |
| Dodecylbenzenesulfonic acid | 1 part by weight |
| Butyltin oxide | 2 parts by weight |

The aforementioned materials are placed in a reaction vessel equipped with a condenser tube, a stirrer and a nitrogen introducing tube, reacted at 140° C. for 15 hours, cooled to 80° C., and reacted with 150 parts by weight of isophorone diisocyanate in ethyl acetate for 2 hours, thereby providing a polyester prepolymer having isocyanate groups on both ends.

| | |
|---|---|
| Cyan pigment (copper phthalocyanine available from Dainichiseika Colour & Chemicals Mfg. Co., Ltd., B15:3) | 50 parts by weight |
| Block polyester resin (used in production of B1) | 350 parts by weight |

The aforementioned materials are mixed in a pressure kneader, thereby producing a pigment-polyester resin composite, which is then pulverized with a hammer mill, thereby providing a pulverized product (X).

| | |
|---|---|
| Fischer-Tropsch wax (FT100, available from Nippon Seiro Co., Ltd.) | 50 parts by weight |
| Linseed oil | 50 parts by weight |

The aforementioned materials are dispersed in 400 parts by weight of ethyl acetate in a semi-dissolved state under heating with a homogenizer, thereby providing a dissolved product (Y).

The components (X) and (Y) are mixed, to which 100 parts by weight of the isocyanate group-containing polyester prepolymer is added, and the mixture is further mixed and dissolved with a homogenizer. 2 parts by weight of a ketimine compound, which is separately prepared by mixing and heating isophorone diamine and methyl ethyl ketone, is added thereto, followed by mixing with a homogenizer.

2,000 parts by weight of ion exchanged water is added thereto, and the mixture is emulsified with a homogenizer. The solvent component is removed over 5 hours under reduced pressure under heating and stirring, and the resulting solid matter is rinsed and dried to provide toner particles.

The toner particles are measured for particle diameter with a Coulter Counter. As a result, the accumulated volume average particle diameter D50 is 5.0 μm, and the volume average particle size distribution index GSDv is 1.25. The shape factor SF1 of the toner particles obtained by shape observation with a Luzex image analyzer is 128, which indicates a potato-like shape.

3 parts by weight of the enzyme in a composite form with inorganic particles (D1) and 1 part by weight of hydrophobic silica (TS720, available from Cabot Speciality Chemicals, Inc., average particle diameter: 12 nm) are added to 50 parts by weight of the toner particles, and mixed with a sample mill, thereby providing an externally added toner. A ferrite carrier having polymethyl methacrylate (available from Soken Chemical & Engineering Co., Ltd.) coated in an amount of 1% and having an average particle diameter of 50 μm is used, and the externally added toner is weighed to make a toner concentration of 5%. The carrier and the toner are mixed and agitated in a ball mill for 5 minutes, thereby providing a developer.

Evaluation of Toner

The developer thus obtained is used in a modified machine of DocuCentre Color f450, available from Fuji Xerox Co., Ltd., in which the two-roller type fixing device is modified to have a maximum fixing pressure of 0.4 MPa. S-Grade paper designated by Fuji Xerox Co., Ltd. is used as transfer paper, and the fixing property is investigated at a process speed controlled to 180 mm/sec. As a result, good pressure fixing property is obtained, and the image exhibits sufficient fixing uniformity in a cloth rubbing test (temperature inside apparatus: 30° C.).

An image is formed by using an OHP sheet V50 for monochrome print designated by Fuji Xerox Co., Ltd. under the aforementioned conditions, and is evaluated for durability of the image by a cloth rubbing test, in which the number of reciprocal rubbing, which is generally 5, is changed to 100. As a result, substantially no wear is observed in the image (A).

100 sheets of OHP sheet V50 for monochrome print each having an image formed are stacked and placed in a chamber at 70° C. for 3 hours. As a result, good heat storage stability is observed without adhesion between the sheets (A).

The resulting toner is measured for a temperature T(10 MPa) where the toner has a viscosity of $10^4$ Pa·s at a pressure of 10 MPa applied with a flow tester and a temperature T(1 MPa) where the toner has a viscosity of $10^4$ Pa·s at a pressure of 1 MPa applied with a flow tester. As a result, T(1 MPa) T(10 MPa) and (T(1 MPa)−T(10 MPa)) are 45° C., 10° C. and 35° C., respectively.

Toner Example 6

A toner is produced in the same manner as in Toner Example 4 except that 1 part by weight of the enzyme in a composite form with inorganic particles (D1) is added in addition to 3 parts by weight of the iron naphthenate in a composite form with inorganic particles (D2), and 20 parts by weight of the reactive particle dispersion liquid (C1) is further added. The toner thus obtained is evaluated in the same manner as above. As a result, the toner exhibits particularly good durability (AA).

Comparative Example 1

A toner is produced in the same manner as in Example 4 except that the enzyme in a composite form with inorganic particles (D1) is not used, and evaluated in the same manner as above. As a result, the image can be fixed, but is worn after the cloth rubbing test approximately 30 times (C). In the evaluation in the chamber at 70° C., the sheets are adhered (C).

Comparative Example 2

A toner is produced in the same manner as in Example 4 except that the resin particle dispersion liquid (B1) is not used, but the same amount of the reactive particle dispersion liquid (C1) is added. The toner is difficult to be fixed, and a toner capable of being evaluated is not obtained.

The evaluation results of Examples and Comparative Examples are shown in Table 1 below.

Evaluation

The evaluation standards for the 100 times cloth rubbing test and the storage test at 70° C. for 3 hours are as follows.

100 Times Cloth Rubbing Test

The surface of the image is rubbed with medical gauze by hand of the tester at a load of approximately 2 kg.

The evaluation standard is as follows.

AA no wear of image and no contamination on gauze

A no wear of image and slight contamination on gauze

B slight wear of image and contamination on gauze

C wear of image and contamination on gauze

Storage at 70° C. for 3 Hours 100 sheets of OHP sheet V50 for monochrome print are stacked and placed in a chamber (laboratory dryer) at 70° C. for 3 hours.

The evaluation standard is as follows.

AA no adhesion between sheets

A no adverse affect on image with slight crackling on sheets

B partial slight adhesion between sheet with partial defect on image

C adhesion between sheets with defect on image

TABLE 1

| | Production method of toner | Resin particle dispersion liquid | Oxidation polymerizable monomer | Polymer having ethylenic unsaturated group | Catalyst in composite form with inorganic particles | D50 of toner (μm) | 100 Times cloth rubbing | Storage at 70° C. for 3 hours | T(1 MPa) (° C.) | T(10 MPa) (° C.) | T(1 MPa) - T(10 MPa) (° C.) |
|---|---|---|---|---|---|---|---|---|---|---|---|
| Example 1 | kneading and pulverizing | resin for B2 | linseed oil | — | D2 | 7.5 | B | B | 70 | 40 | 30 |
| Example 2 | chemical (aggregation method) | A1 | linseed oil (in C1) | — | D1 | 5.2 | A | A | 60 | 10 | 50 |
| Example 3 | chemical (aggregation method) | B1 | — | unsaturated polyester resin (in C2) | D2 | 5.0 | A | A | 50 | 10 | 40 |
| Example 4 | chemical (aggregation method) | B1 | — | unsaturated polyester resin (in C2) | D1 and D2 | 5.0 | AA | A | 50 | 10 | 40 |
| Example 5 | chemical (polyaddition reaction) | resin for B1 | linseed oil | — | D1 | 5.0 | A | A | 45 | 10 | 35 |
| Example 6 | chemical (aggregation method) | B1 | linseed oil (in C1) | unsaturated polyester resin (in C2) | D1 and D2 | 5.5 | AA | AA | 50 | 10 | 40 |
| Comparative Example 1 | chemical (aggregation method) | B1 | — | unsaturated polyester resin (in C2) | — | 5.0 | C | C | 50 | 10 | 40 |
| Comparative Example 2 | chemical (aggregation method) | — | linseed oil (in C1) | unsaturated polyester resin (in C2) | D1 and D2 | 5.2 | incapable evaluation | incapable evaluation | 80 | 65 | 15 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A toner for developing an electrostatic image, comprising:

a toner particle having at least one of an oxidation polymerizable monomer and a polymer having an ethylenically unsaturated group, and an outer additive containing an oxidation polymerization catalyst in a form of a composite with inorganic particles, wherein the oxidation polymerization catalyst includes an enzyme, wherein a temperature T(10 Mpa) and a temperature T(1 Mpa) satisfies the following expression (1):

$$20° \text{ C.} \leq T(1 \text{ MPa}) - T(10 \text{ MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

2. The toner for developing an electrostatic image according to claim 1, wherein the oxidation polymerization catalyst is included in at least one of an outer shell of the toner and a surface of the toner.

3. The toner for developing an electrostatic image according to claim 1, wherein a binder resin of the toner has a core/shell structure, and difference between a glass transition temperature of a resin constituting the core and a glass transition temperature of a resin constituting the shell is from approximately 20° C. to approximately 120° C.

4. The toner for developing an electrostatic image according to claim 1, wherein a binder resin of the toner includes a block copolymer.

5. The toner for developing an electrostatic image according to claim 1, wherein the oxidation polymerization catalyst further comprises an iron compound.

6. The toner for developing an electrostatic image according to claim 1, wherein the polymer having an ethylenically unsaturated group is a polyester.

7. The toner for developing an electrostatic image according to claim 1, wherein the oxidation polymerizable monomer is a drying oil having an ethylenically unsaturated group.

8. The toner for developing an electrostatic image according to claim 1, wherein a content of the oxidation polymerization catalyst in a form of a composite with inorganic particles is from approximately 0.001% to approximately 10.0% by weight based on the total weight of the toner.

9. The toner for developing an electrostatic image according to claim 1, wherein the oxidation polymerization catalyst in a form of a composite with inorganic particles has a volume average particle diameter of from approximately 0.001 μm to approximately 3.0 μm.

10. The toner for developing an electrostatic image according to claim 3, wherein a high glass transition temperature phase of the resin constituting the core and the resin constituting the shell has a glass transition temperature of from approximately 40° C. to approximately 80° C.

11. The toner for developing an electrostatic image according to claim 3, wherein the resin constituting the core has a weight average molecular weight of from approximately 3,000 to approximately 50,000.

12. The toner for developing an electrostatic image according to claim 3, wherein the binder resin having a core/shell structure has a median diameter of from approximately ½ to approximately 1/1,000 with respect to a volume average particle diameter of the toner.

13. A developer for an electrostatic image, comprising a toner for developing an electrostatic image and a carrier, the toner comprising:

a toner particle having at least one of an oxidation polymerizable monomer and a polymer having an ethylenically unsaturated group, and an outer additive containing an oxidation polymerization catalyst in a form of a composite with inorganic particles, wherein the oxidation polymerization catalyst includes an enzyme, wherein a temperature T(10 Mpa) and a temperature T(1 Mpa) satisfies the following expression (1):

$$20° \text{ C.} \leq T(1 \text{ MPa}) - T(10 \text{ MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

14. A toner cartridge comprising the toner for developing an electrostatic image, the toner comprising:

a toner particle having at least one of an oxidation polymerizable monomer and a polymer having an ethylenically unsaturated group, and an outer additive containing an oxidation polymerization catalyst in a form of a composite with inorganic particles, wherein the oxidation polymerization catalyst includes an enzyme, wherein a temperature T(10 Mpa) and a temperature T(1 Mpa) satisfies the following expression (1):

$$20° \text{ C.} \leq T(1 \text{ MPa}) - T(10 \text{ MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

15. A process cartridge detachably attachable to an image forming apparatus, comprising the developer, and comprising at least one selected from the group consisting of a developing unit that develops an electrostatic latent image formed on a surface of an image holding member with the toner for developing an electrostatic image or the developer for an electrostatic image, thereby forming a toner image, a charging unit that charges the image holding member and the surface of the image holding member, and a cleaning unit that removes the toner remaining on the surface of the image holding member, wherein the developer comprises a toner for developing an electrostatic image and a carrier, the toner comprising:

a toner particle having at least one of an oxidation polymerizable monomer and a polymer having an ethylenically unsaturated group, and an outer additive containing an oxidation polymerization catalyst in a form of a composite with inorganic particles, wherein the oxidation polymerization catalyst includes an enzyme, wherein a temperature T(10 Mpa) and a temperature T(1 Mpa) satisfies the following expression (1):

$$20° \text{ C.} \leq T(1 \text{ MPa}) - T(10 \text{ MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

16. An image forming apparatus comprising: an image holding member; a charging unit that charges the image holding member; an exposing unit that exposes the charged image holding member, thereby forming an electrostatic latent image on the image holding member; a developing unit that develops the electrostatic latent image with a developer, thereby forming a toner image; a transferring unit that transfers the toner image from the image holding member to a transfer material; and a fixing unit that fixes the toner image, the developer being the developer for an electrostatic image, wherein the developer comprises a toner for developing an electrostatic image and a carrier, the toner comprising:

a toner particle having at least one of an oxidation polymerizable monomer and a polymer having an ethylenically unsaturated group, and an outer additive containing an oxidation polymerization catalyst in a form of a composite with inorganic particles, wherein the oxidation polymerization catalyst includes an enzyme, wherein a temperature T(10 Mpa) and a temperature T(1 Mpa) satisfies the following expression (1):

$$20° \text{ C.} \leq T(1 \text{ MPa}) - T(10 \text{ MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

17. An image forming method comprising: charging an image holding member; forming an electrostatic latent image on a surface of the image holding member; developing the electrostatic latent image formed on the surface of the image holding member, with a developer for an electrostatic image, thereby forming a toner image; transferring the toner image formed on the surface of the image holding member, to a surface of a transfer material; and fixing the toner image, the developer comprises a toner for developing an electrostatic image and a carrier, the toner comprising:

a toner particle having at least one of an oxidation polymerizable monomer and a polymer having an ethylenically unsaturated group, and an outer additive containing an oxidation polymerization catalyst in a form of a composite with inorganic particles, wherein the oxidation polymerization catalyst includes an enzyme, wherein a temperature T(10 Mpa) and a temperature T(1 Mpa) satisfies the following expression (1):

$$20° \text{ C.} \leq T(1 \text{ MPa}) - T(10 \text{ MPa}) \quad (1)$$

wherein, the temperature T(10 Mpa) is a temperature at which a viscosity of the toner under a pressure of 10 Mpa applied with a flow tester becomes $10^4$ Pa·s, and the temperature T(1 Mpa) is a temperature at which a viscosity of the toner under a pressure of 1 Mpa applied with a flow tester becomes $10^4$ Pa·s.

* * * * *